US011323835B2

(12) United States Patent
Lee

(10) Patent No.: US 11,323,835 B2
(45) Date of Patent: May 3, 2022

(54) METHOD OF INSPECTING SOUND INPUT/OUTPUT DEVICE

(71) Applicant: LG ELECTRONICS INC., Seoul (KR)

(72) Inventor: Kyuho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/030,239

(22) Filed: Sep. 23, 2020

(65) Prior Publication Data

US 2021/0152964 A1 May 20, 2021

(30) Foreign Application Priority Data

Nov. 20, 2019 (KR) ..... 10-2019-0149537

(51) Int. Cl.
*H04R 29/00* (2006.01)
*G10L 25/06* (2013.01)

(52) U.S. Cl.
CPC ..... *H04R 29/001* (2013.01); *G10L 25/06* (2013.01); *H04R 29/004* (2013.01)

(58) Field of Classification Search
None
See application file for complete search history.

(56) References Cited

U.S. PATENT DOCUMENTS

| | | | | |
|---|---|---|---|---|
| 6,766,025 | B1 * | 7/2004 | Levy | H04R 3/04 381/56 |
| 8,917,878 | B2 * | 12/2014 | Lyu | H04R 29/004 381/58 |
| 9,930,463 | B2 * | 3/2018 | Little | G06F 3/165 |
| 10,530,917 | B2 * | 1/2020 | Every | H03G 3/20 |
| 10,805,754 | B2 * | 10/2020 | Christoph | H04S 7/306 |
| 10,825,440 | B2 * | 11/2020 | Alderson | G10K 11/17825 |
| 2003/0179891 | A1 * | 9/2003 | Rabinowitz | H04R 3/12 381/103 |
| 2008/0037804 | A1 * | 2/2008 | Shmunk | H04R 3/04 381/96 |
| 2010/0239097 | A1 * | 9/2010 | Trautmann | H04R 3/04 381/56 |
| 2011/0222696 | A1 * | 9/2011 | Balachandran | H04R 29/001 381/58 |
| 2017/0243576 | A1 * | 8/2017 | Millington | G10L 15/22 |

* cited by examiner

*Primary Examiner* — Paul W Huber
(74) *Attorney, Agent, or Firm* — Lee Hong Degerman Kang & Waimey

(57) ABSTRACT

A method of inspecting a sound input/output device is disclosed. A method of inspecting a sound input/output device according to an embodiment of the present disclosure can diagnose an error state of either a speaker or a microphone based on a cross-correlation of input/output signals by receiving a sound signal from an AI device through the microphone. The method of inspecting of the present disclosure may be associated with an artificial intelligence module, a drone ((Unmanned Aerial Vehicle, UAV), a robot, an AR (Augmented Reality) device, a VR (Virtual Reality) device, a device associated with 5G services, etc.

16 Claims, 16 Drawing Sheets

METHOD OF INSPECTING SOUND INPUT/OUTPUT DEVICE

CROSS-REFERENCE TO RELATED APPLICATION

Pursuant to 35 U.S.C. § 119(a), this application claims the benefit of earlier filing date and right of priority to Korean Patent Application No. 10-2019-0149537, filed on Nov. 20, 2019, the contents of which are hereby incorporated by reference herein in its entirety.

BACKGROUND OF THE INVENTION

Field of the Invention

The present disclosure relates to a method of inspecting a sound input/output device.

Description of the Related Art

Machine learning is an algorithm technique that it itself may classify and learn the features of input data. The component technology is a technique for mimicking the human brain's perception and decision capabilities using a machine learning algorithm (e.g., deep learning), and this may be divided into several technical fields, such as linguistic understanding, visual understanding, inference/prediction, knowledge expression, and operation control.

In particular, in various technical fields related to speech processing, since the sound input/output device must maintain appropriate performance in order to achieve the target effect of speech recognition and/or speech synthesis, it is necessary to continuously monitor electronic devices and secure the reliability of the monitoring results.

SUMMARY OF THE INVENTION

The present disclosure is intended to solve address the above-described needs and/or problems.

In addition, an object of the present disclosure is to implement a method of inspecting a sound input/output device capable of self-inspecting the performance of the sound input/output device.

In addition, an object of the present disclosure is to implement a method of inspecting a sound input/output device capable of improving the reliability of inspection results using a deep learning model.

A method of inspecting a sound input/output device according to an aspect of the present disclosure includes outputting a sound signal through a speaker, and receiving a feedback signal of the sound through a microphone; acquiring a first spectrum for the sound signal and a second spectrum for the feedback signal when at least one specific signal for inspecting performance of the speaker or the microphone is detected from the sound signal; and detecting an error state of either the speaker or the microphone by using a correlation between the first and second spectrums.

In addition, the sound signal and the feedback signal may be multitone sound waves composed of a linear sum of sinusoidal waves having a plurality of frequency components.

In addition, the detecting an error state may include calculating a cross-correlation coefficient between the first and second spectrums; and detecting an error state of either the speaker or the microphone by comparing the cross-correlation coefficient with a predetermined threshold.

In addition, the method may further include extracting a plurality of reference points having the cross-correlation coefficient equal to or greater than a predetermined reference value, and determining a section between the extracted reference points as an error analysis section.

In addition, the method may further include calculating a cross-correlation coefficient of each of a plurality of frequency bands for the sound signal and the feedback signal; and determining as the error state when an average value of the cross-correlation coefficient of each of the plurality of frequency bands is less than the predetermined threshold.

In addition, the method may further include calculating a cross-correlation coefficient of each of a plurality of frequency bands for the sound signal and the feedback signal; determining a noise level by receiving ambient noise through the microphone, and determining a reverberation level of the feedback signal; generating an output by applying an average value of the cross-correlation coefficient of each of the plurality of frequency bands, the noise level, and the reverberation level to a pre-learned error detection model; and determining the error state based on the output.

In addition, the at least one specific signal may be a voice signal for a predetermined wake-up word.

In addition, when the at least one specific signal is not detected for a predetermined time, the first and second spectrums may be acquired in response to a general sound signal, and the error state may be detected.

In addition, the method may further include, when the at least one specific signal is not detected for a predetermined time, adding a signal having a highest output frequency for the predetermined time to the at least one specific signal.

In addition, the method may further include searching a history related to the detection of the error state; and controlling an AI device having the sound input/output device to travel to a designated place if the same detection result is repeated more than a predetermined number.

A method of inspecting a sound input/output device according to another aspect of the present disclosure includes receiving sound signal information output from an external device and feedback signal information on the output sound signal from the external device; acquiring a first spectrum for the sound signal and a second spectrum for the feedback signal when at least one specific signal for inspecting performance of a speaker or a microphone is detected from the sound signal information; and detecting an error state of either the speaker or the microphone by using a correlation between the first and second spectrums.

Effects of the method of inspecting a sound input/output device according to an embodiment of the present disclosure will be described as follows.

The present disclosure can self-inspect the performance of the sound input/output device.

In addition, the present disclosure can improve the reliability of inspection results using a deep learning model.

The effects obtained in the present disclosure are not limited to the above-mentioned effects, and other effects not mentioned will be clearly understood by those skilled in the art from the following description.

BRIEF DESCRIPTION OF THE DRAWINGS

A more complete appreciation of the disclosure and many of the attendant aspects thereof will be readily obtained as the same becomes better understood by reference to the following detailed description when considered in connection with the accompanying drawings, wherein.

DETAILED DESCRIPTION OF THE EMBODIMENTS

Hereinafter, embodiments of the disclosure will be described in detail with reference to the attached drawings. The same or similar components are given the same reference numbers and redundant description thereof is omitted. The suffixes "module" and "unit" of elements herein are used for convenience of description and thus can be used interchangeably and do not have any distinguishable meanings or functions. Further, in the following description, if a detailed description of known techniques associated with the present invention would unnecessarily obscure the gist of the present invention, detailed description thereof will be omitted. In addition, the attached drawings are provided for easy understanding of embodiments of the disclosure and do not limit technical spirits of the disclosure, and the embodiments should be construed as including all modifications, equivalents, and alternatives falling within the spirit and scope of the embodiments.

While terms, such as "first", "second", etc., may be used to describe various components, such components must not be limited by the above terms. The above terms are used only to distinguish one component from another.

When an element is "coupled" or "connected" to another element, it should be understood that a third element may be present between the two elements although the element may be directly coupled or connected to the other element. When an element is "directly coupled" or "directly connected" to another element, it should be understood that no element is present between the two elements.

The singular forms are intended to include the plural forms as well, unless the context clearly indicates otherwise.

In addition, in the specification, it will be further understood that the terms "comprise" and "include" specify the presence of stated features, integers, steps, operations, elements, components, and/or combinations thereof, but do not preclude the presence or addition of one or more other features, integers, steps, operations, elements, components, and/or combinations.

Hereinafter, 5G communication (5th generation mobile communication) required by an apparatus requiring AI processed information and/or an AI processor will be described through paragraphs A through G.

A. Example of Block Diagram of UE and 5G Network

Figure 1:
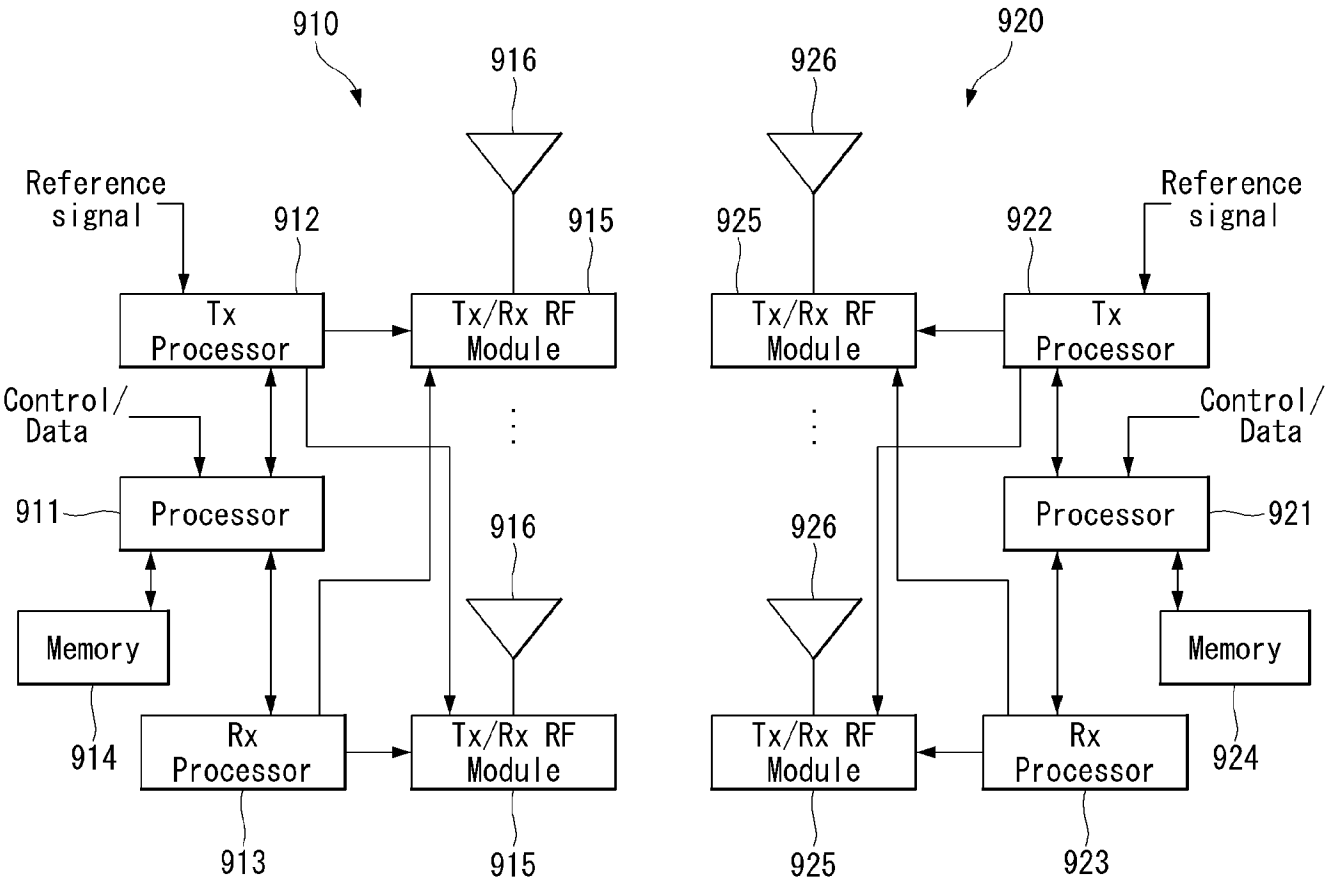
FIG. 1 is a block diagram of a wireless communication system to which methods proposed in the disclosure are applicable.

FIG. 1 is a block diagram of a wireless communication system to which methods proposed in the disclosure are applicable.

Referring to FIG. 1, a device (AI device) including an AI module is defined as a first communication device (910 of FIG. 1), and a processor 911 can perform detailed AI operation.

A 5G network including another device(AI server) communicating with the AI device is defined as a second communication device (920 of FIG. 1), and a processor 921 can perform detailed AI operations.

The 5G network may be represented as the first communication device and the AI device may be represented as the second communication device.

For example, the first communication device or the second communication device may be a base station, a network node, a transmission terminal, a reception terminal, a wireless device, a wireless communication device, an autonomous device, or the like.

For example, the first communication device or the second communication device may be a base station, a network node, a transmission terminal, a reception terminal, a wireless device, a wireless communication device, a vehicle, a vehicle having an autonomous function, a connected car, a drone (Unmanned Aerial Vehicle, UAV), and AI (Artificial Intelligence) module, a robot, an AR (Augmented Reality) device, a VR (Virtual Reality) device, an MR (Mixed Reality) device, a hologram device, a public safety device, an MTC device, an IoT device, a medical device, a Fin Tech device (or financial device), a security device, a climate/environment device, a device associated with 5G services, or other devices associated with the fourth industrial revolution field.

For example, a terminal or user equipment (UE) may include a cellular phone, a smart phone, a laptop computer, a digital broadcast terminal, personal digital assistants (PDAs), a portable multimedia player (PMP), a navigation device, a slate PC, a tablet PC, an ultrabook, a wearable device (e.g., a smartwatch, a smart glass and a head mounted display (HMD)), etc. For example, the HMD may be a display device worn on the head of a user. For example, the HMD may be used to realize VR, AR or MR. For example, the drone may be a flying object that flies by wireless control signals without a person therein. For example, the VR device may include a device that implements objects or backgrounds of a virtual world. For example, the AR device may include a device that connects and implements objects or background of a virtual world to objects, backgrounds, or the like of a real world. For example, the MR device may include a device that unites and implements objects or background of a virtual world to objects, backgrounds, or the like of a real world. For example, the hologram device may include a device that implements 360-degree 3D images by recording and playing 3D information using the interference phenomenon of light that is generated by two lasers meeting each other which is called holography. For example, the public safety device may include an image repeater or an imaging device that can be worn on the body of a user. For example, the MTC device and the IoT device may be devices that do not require direct interference or operation by a person. For example, the MTC device and the IoT device may include a smart meter, a bending machine, a thermometer, a smart bulb, a door lock, various sensors, or the like. For example, the medical device may be a device that is used to diagnose, treat, attenuate, remove, or prevent diseases. For example, the medical device may be a device that is used to diagnose, treat, attenuate, or correct injuries or disorders. For example, the medial device may be a device that is used to examine, replace, or change structures or functions. For example, the medical device may be a device that is used to control pregnancy. For example, the medical device may include a device for medical treatment, a device for operations, a device for (external) diagnose, a hearing aid, an operation device, or the like. For example, the security device may be a device that is installed to prevent a danger that is likely to occur and to keep safety. For example, the security device may be a camera, a CCTV, a recorder, a black box, or the like. For example, the Fin Tech device may be a device that can provide financial services such as mobile payment.

Referring to FIG. 1, the first communication device 910 and the second communication device 920 include processors 911 and 921, memories 914 and 924, one or more Tx/Rx radio frequency (RF) modules 915 and 925, Tx processors 912 and 922, Rx processors 913 and 923, and antennas 916 and 926. The Tx/Rx module is also referred to as a transceiver. Each Tx/Rx module 915 transmits a signal through each antenna 926. The processor implements the aforementioned functions, processes and/or methods. The processor 921 may be related to the memory 924 that stores program code and data. The memory may be referred to as a computer-readable medium. More specifically, the Tx processor 912 implements various signal processing functions with respect to L1 (i.e., physical layer) in DL (communication from the first communication device to the second communication device). The Rx processor implements various signal processing functions of L1 (i.e., physical layer).

UL (communication from the second communication device to the first communication device) is processed in the first communication device 910 in a way similar to that described in association with a receiver function in the second communication device 920. Each Tx/Rx module 925 receives a signal through each antenna 926. Each Tx/Rx module provides RF carriers and information to the Rx processor 923. The processor 921 may be related to the memory 924 that stores program code and data. The memory may be referred to as a computer-readable medium.

B. Signal Transmission/Reception Method in Wireless Communication System

Figure 2:
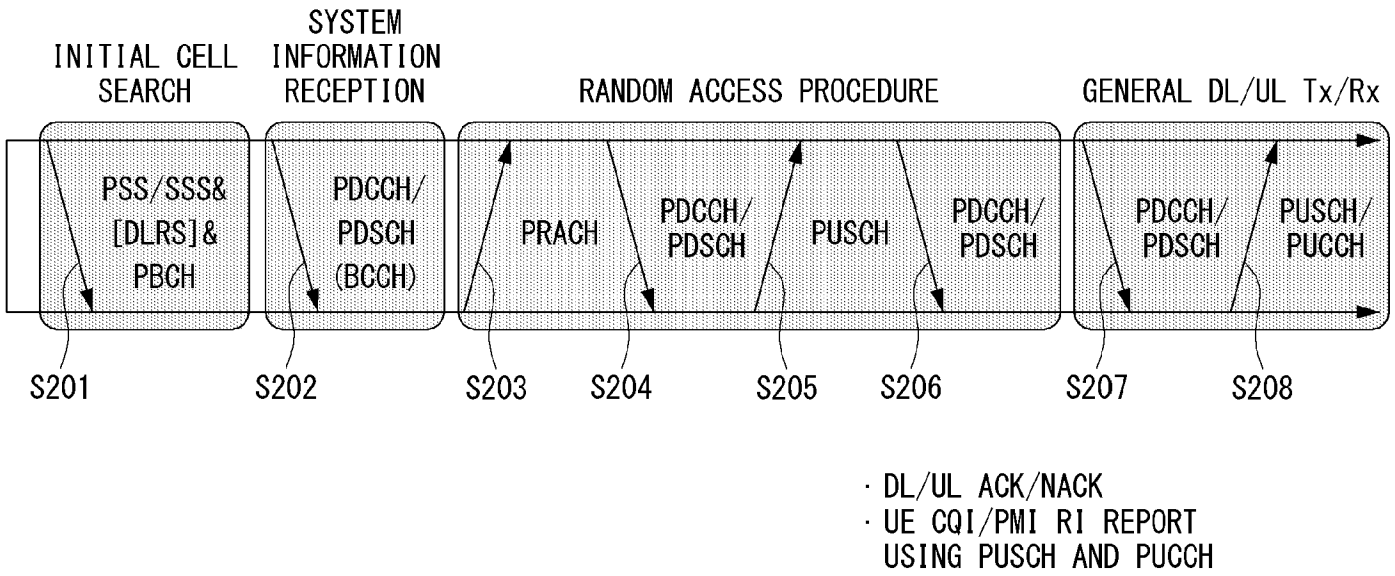
FIG. 2 is a diagram showing an example of a signal transmission/reception method in a wireless communication system.

FIG. 2 is a diagram showing an example of a signal transmission/reception method in a wireless communication system.

Referring to FIG. 2, when a UE is powered on or enters a new cell, the UE performs an initial cell search operation such as synchronization with a BS (S201). For this operation, the UE can receive a primary synchronization channel (P-SCH) and a secondary synchronization channel (S-SCH) from the BS to synchronize with the BS and acquire information such as a cell ID. In LTE and NR systems, the P-SCH and S-SCH are respectively called a primary synchronization signal (PSS) and a secondary synchronization signal (SSS). After initial cell search, the UE can acquire broadcast information in the cell by receiving a physical broadcast channel (PBCH) from the BS. Further, the UE can receive a downlink reference signal (DL RS) in the initial cell search step to check a downlink channel state. After initial cell search, the UE can acquire more detailed system information by receiving a physical downlink shared channel (PDSCH) according to a physical downlink control channel (PDCCH) and information included in the PDCCH (S202).

Meanwhile, when the UE initially accesses the BS or has no radio resource for signal transmission, the UE can perform a random access procedure (RACH) for the BS (steps S203 to S206). To this end, the UE can transmit a specific sequence as a preamble through a physical random access channel (PRACH) (S203 and S205) and receive a random access response (RAR) message for the preamble through a PDCCH and a corresponding PDSCH (S204 and S206). In the case of a contention-based RACH, a contention resolution procedure may be additionally performed.

After the UE performs the above-described process, the UE can perform PDCCH/PDSCH reception (S207) and physical uplink shared channel (PUSCH)/physical uplink control channel (PUCCH) transmission (S208) as normal uplink/downlink signal transmission processes. Particularly, the UE receives downlink control information (DCI) through the PDCCH. The UE monitors a set of PDCCH candidates in monitoring occasions set for one or more control element sets (CORESET) on a serving cell according to corresponding search space configurations. A set of PDCCH candidates to be monitored by the UE is defined in terms of search space sets, and a search space set may be a common search space set or a UE-specific search space set. CORESET includes a set of (physical) resource blocks having a duration of one to three OFDM symbols. A network can configure the UE such that the UE has a plurality of CORESETs. The UE monitors PDCCH candidates in one or more search space sets. Here, monitoring means attempting decoding of PDCCH candidate(s) in a search space. When the UE has successfully decoded one of PDCCH candidates in a search space, the UE determines that a PDCCH has been detected from the PDCCH candidate and performs PDSCH reception or PUSCH transmission on the basis of DCI in the detected PDCCH. The PDCCH can be used to schedule DL transmissions over a PDSCH and UL transmissions over a PUSCH. Here, the DCI in the PDCCH includes downlink assignment (i.e., downlink grant (DL grant)) related to a physical downlink shared channel and including at least a modulation and coding format and resource allocation information, or an uplink grant (UL grant) related to a physical uplink shared channel and including a modulation and coding format and resource allocation information.

An initial access (IA) procedure in a 5G communication system will be additionally described with reference to FIG. 2.

The UE can perform cell search, system information acquisition, beam alignment for initial access, and DL measurement on the basis of an SSB. The SSB is interchangeably used with a synchronization signal/physical broadcast channel (SS/PBCH) block.

The SSB includes a PSS, an SSS and a PBCH. The SSB is configured in four consecutive OFDM symbols, and a PSS, a PBCH, an SSS/PBCH or a PBCH is transmitted for each OFDM symbol. Each of the PSS and the SSS includes one OFDM symbol and 127 subcarriers, and the PBCH includes 3 OFDM symbols and 576 subcarriers.

Cell search refers to a process in which a UE acquires time/frequency synchronization of a cell and detects a cell identifier (ID) (e.g., physical layer cell ID (PCI)) of the cell. The PSS is used to detect a cell ID in a cell ID group and the SSS is used to detect a cell ID group. The PBCH is used to detect an SSB (time) index and a half-frame.

There are 336 cell ID groups and there are 3 cell IDs per cell ID group. A total of 1008 cell IDs are present. Information on a cell ID group to which a cell ID of a cell belongs is provided/acquired through an SSS of the cell, and information on the cell ID among 336 cell ID groups is provided/acquired through a PSS.

The SSB is periodically transmitted in accordance with SSB periodicity. A default SSB periodicity assumed by a UE during initial cell search is defined as 20 ms. After cell access, the SSB periodicity can be set to one of {5 ms, 10 ms, 20 ms, 40 ms, 80 ms, 160 ms} by a network (e.g., a BS).

Next, acquisition of system information (SI) will be described.

SI is divided into a master information block (MIB) and a plurality of system information blocks (SIBs). SI other than the MIB may be referred to as remaining minimum system information. The MIB includes information/parameter for monitoring a PDCCH that schedules a PDSCH carrying SIB1 (SystemInformationBlock1) and is transmitted by a BS through a PBCH of an SSB. SIB1 includes information related to availability and scheduling (e.g., transmission periodicity and SI-window size) of the remaining SIBs (hereinafter, SIBx, x is an integer equal to or greater than 2). SiBx is included in an SI message and transmitted over a PDSCH. Each SI message is transmitted within a periodically generated time window (i.e., SI-window).

A random access (RA) procedure in a 5G communication system will be additionally described with reference to FIG. 2.

A random access procedure is used for various purposes. For example, the random access procedure can be used for network initial access, handover, and UE-triggered UL data transmission. A UE can acquire UL synchronization and UL transmission resources through the random access procedure. The random access procedure is classified into a contention-based random access procedure and a contention-free random access procedure. A detailed procedure for the contention-based random access procedure is as follows.

A UE can transmit a random access preamble through a PRACH as Msg1 of a random access procedure in UL. Random access preamble sequences having different two lengths are supported. A long sequence length 839 is applied to subcarrier spacings of 1.25 kHz and 5 kHz and a short sequence length 139 is applied to subcarrier spacings of 15 kHz, 30 kHz, 60 kHz and 120 kHz.

When a BS receives the random access preamble from the UE, the BS transmits a random access response (RAR) message (Msg2) to the UE. A PDCCH that schedules a PDSCH carrying a RAR is CRC masked by a random access (RA) radio network temporary identifier (RNTI) (RA-RNTI) and transmitted. Upon detection of the PDCCH masked by the RA-RNTI, the UE can receive a RAR from the PDSCH scheduled by DCI carried by the PDCCH. The UE checks whether the RAR includes random access response information with respect to the preamble transmitted by the UE, that is, Msg1. Presence or absence of random access information with respect to Msg1 transmitted by the UE can be determined according to presence or absence of a random access preamble ID with respect to the preamble transmitted by the UE. If there is no response to Msg1, the UE can retransmit the RACH preamble less than a predetermined number of times while performing power ramping. The UE calculates PRACH transmission power for preamble retransmission on the basis of most recent pathloss and a power ramping counter.

The UE can perform UL transmission through Msg3 of the random access procedure over a physical uplink shared channel on the basis of the random access response information. Msg3 can include an RRC connection request and a UE ID. The network can transmit Msg4 as a response to Msg3, and Msg4 can be handled as a contention resolution message on DL. The UE can enter an RRC connected state by receiving Msg4.

C. Beam Management (BM) Procedure of 5G Communication System

A BM procedure can be divided into (1) a DL MB procedure using an SSB or a CSI-RS and (2) a UL BM procedure using a sounding reference signal (SRS). In addition, each BM procedure can include Tx beam swiping for determining a Tx beam and Rx beam swiping for determining an Rx beam.

The DL BM procedure using an SSB will be described.

Configuration of a beam report using an SSB is performed when channel state information (CSI)/beam is configured in RRC_CONNECTED.

A UE receives a CSI-ResourceConfig IE including CSI-SSB-ResourceSetList for SSB resources used for BM from a BS. The RRC parameter "csi-SSB-ResourceSetList" represents a list of SSB resources used for beam management and report in one resource set. Here, an SSB resource set can be set as {SSBx1, SSBx2, SSBx3, SSBx4, . . . }. An SSB index can be defined in the range of 0 to 63.

The UE receives the signals on SSB resources from the BS on the basis of the CSI-SSB-ResourceSetList.

When CSI-RS reportConfig with respect to a report on SSBRI and reference signal received power (RSRP) is set, the UE reports the best SSBRI and RSRP corresponding thereto to the BS. For example, when reportQuantity of the CSI-RS reportConfig IE is set to 'ssb-Index-RSRP', the UE reports the best SSBRI and RSRP corresponding thereto to the BS.

When a CSI-RS resource is configured in the same OFDM symbols as an SSB and 'QCL-TypeD' is applicable, the UE can assume that the CSI-RS and the SSB are quasi co-located (QCL) from the viewpoint of 'QCL-TypeD'. Here, QCL-TypeD may mean that antenna ports are quasi co-located from the viewpoint of a spatial Rx parameter. When the UE receives signals of a plurality of DL antenna ports in a QCL-TypeD relationship, the same Rx beam can be applied.

Next, a DL BM procedure using a CSI-RS will be described.

An Rx beam determination (or refinement) procedure of a UE and a Tx beam swiping procedure of a BS using a CSI-RS will be sequentially described. A repetition parameter is set to 'ON' in the Rx beam determination procedure of a UE and set to 'OFF' in the Tx beam swiping procedure of a BS.

First, the Rx beam determination procedure of a UE will be described.

The UE receives an NZP CSI-RS resource set IE including an RRC parameter with respect to 'repetition' from a BS through RRC signaling. Here, the RRC parameter 'repetition' is set to 'ON'.

The UE repeatedly receives signals on resources in a CSI-RS resource set in which the RRC parameter 'repetition' is set to 'ON' in different OFDM symbols through the same Tx beam (or DL spatial domain transmission filters) of the BS.

The UE determines an RX beam thereof.

The UE skips a CSI report. That is, the UE can skip a CSI report when the RRC parameter 'repetition' is set to 'ON'.

Next, the Tx beam determination procedure of a BS will be described.

A UE receives an NZP CSI-RS resource set IE including an RRC parameter with respect to 'repetition' from the BS through RRC signaling. Here, the RRC parameter 'repetition' is related to the Tx beam swiping procedure of the BS when set to 'OFF'.

The UE receives signals on resources in a CSI-RS resource set in which the RRC parameter 'repetition' is set to 'OFF' in different DL spatial domain transmission filters of the BS.

The UE selects (or determines) a best beam.

The UE reports an ID (e.g., CRI) of the selected beam and related quality information (e.g., RSRP) to the BS. That is, when a CSI-RS is transmitted for BM, the UE reports a CRI and RSRP with respect thereto to the BS.

Next, the UL BM procedure using an SRS will be described.

A UE receives RRC signaling (e.g., SRS-Config IE) including a (RRC parameter) purpose parameter set to 'beam management" from a BS. The SRS-Config IE is used to set SRS transmission. The SRS-Config IE includes a list of SRS-Resources and a list of SRS-ResourceSets. Each SRS resource set refers to a set of SRS-resources.

The UE determines Tx beamforming for SRS resources to be transmitted on the basis of SRS-SpatialRelation Info included in the SRS-Config IE. Here, SRS-SpatialRelation Info is set for each SRS resource and indicates whether the same beamforming as that used for an SSB, a CSI-RS or an SRS will be applied for each SRS resource.

When SRS-SpatialRelationInfo is set for SRS resources, the same beamforming as that used for the SSB, CSI-RS or SRS is applied. However, when SRS-SpatialRelationInfo is not set for SRS resources, the UE arbitrarily determines Tx beamforming and transmits an SRS through the determined Tx beamforming.

Next, a beam failure recovery (BFR) procedure will be described.

In a beamformed system, radio link failure (RLF) may frequently occur due to rotation, movement or beamforming blockage of a UE. Accordingly, NR supports BFR in order to prevent frequent occurrence of RLF. BFR is similar to a radio link failure recovery procedure and can be supported when a UE knows new candidate beams. For beam failure detection, a BS configures beam failure detection reference signals for a UE, and the UE declares beam failure when the number of beam failure indications from the physical layer of the UE reaches a threshold set through RRC signaling within a period set through RRC signaling of the BS. After beam failure detection, the UE triggers beam failure recovery by initiating a random access procedure in a PCell and performs beam failure recovery by selecting a suitable beam. (When the BS provides dedicated random access resources for certain beams, these are prioritized by the UE). Completion of the aforementioned random access procedure is regarded as completion of beam failure recovery.

D. URLLC (Ultra-Reliable and Low Latency Communication)

URLLC transmission defined in NR can refer to (1) a relatively low traffic size, (2) a relatively low arrival rate, (3) extremely low latency requirements (e.g., 0.5 and 1 ms), (4) relatively short transmission duration (e.g., 2 OFDM symbols), (5) urgent services/messages, etc. In the case of UL, transmission of traffic of a specific type (e.g., URLLC) needs to be multiplexed with another transmission (e.g., eMBB) scheduled in advance in order to satisfy more stringent latency requirements. In this regard, a method of providing information indicating preemption of specific resources to a UE scheduled in advance and allowing a URLLC UE to use the resources for UL transmission is provided.

NR supports dynamic resource sharing between eMBB and URLLC. eMBB and URLLC services can be scheduled on non-overlapping time/frequency resources, and URLLC transmission can occur in resources scheduled for ongoing eMBB traffic. An eMBB UE may not ascertain whether PDSCH transmission of the corresponding UE has been partially punctured and the UE may not decode a PDSCH due to corrupted coded bits. In view of this, NR provides a preemption indication. The preemption indication may also be referred to as an interrupted transmission indication.

With regard to the preemption indication, a UE receives DownlinkPreemption IE through RRC signaling from a BS. When the UE is provided with DownlinkPreemption IE, the UE is configured with INT-RNTI provided by a parameter int-RNTI in DownlinkPreemption IE for monitoring of a PDCCH that conveys DCI format 2_1. The UE is additionally configured with a corresponding set of positions for fields in DCI format 2_1 according to a set of serving cells and positionInDCI by INT-ConfigurationPerServing Cell including a set of serving cell indexes provided by servingCellID, configured having an information payload size for DCI format 2_1 according to dci-Payloadsize, and configured with indication granularity of time-frequency resources according to timeFrequencySect.

The UE receives DCI format 2_1 from the BS on the basis of the DownlinkPreemption IE.

When the UE detects DCI format 2_1 for a serving cell in a configured set of serving cells, the UE can assume that there is no transmission to the UE in PRBs and symbols indicated by the DCI format 2_1 in a set of PRBs and a set of symbols in a last monitoring period before a monitoring period to which the DCI format 2_1 belongs. For example, the UE assumes that a signal in a time-frequency resource indicated according to preemption is not DL transmission scheduled therefor and decodes data on the basis of signals received in the remaining resource region.

E. mMTC (massive MTC)

mMTC (massive Machine Type Communication) is one of 5G scenarios for supporting a hyper-connection service providing simultaneous communication with a large number of UEs. In this environment, a UE intermittently performs communication with a very low speed and mobility. Accordingly, a main goal of mMTC is operating a UE for a long time at a low cost. With respect to mMTC, 3GPP deals with MTC and NB (NarrowBand)-IoT.

mMTC has features such as repetitive transmission of a PDCCH, a PUCCH, a PDSCH (physical downlink shared channel), a PUSCH, etc., frequency hopping, retuning, and a guard period.

That is, a PUSCH (or a PUCCH (particularly, a long PUCCH) or a PRACH) including specific information and a PDSCH (or a PDCCH) including a response to the specific information are repeatedly transmitted. Repetitive transmission is performed through frequency hopping, and for repetitive transmission, (RF) retuning from a first frequency resource to a second frequency resource is performed in a guard period and the specific information and the response to the specific information can be transmitted/received through a narrowband (e.g., 6 resource blocks (RBs) or 1 RB).

F. Basic Operation Between User Equipments Using 5G Communication

Figure 3:
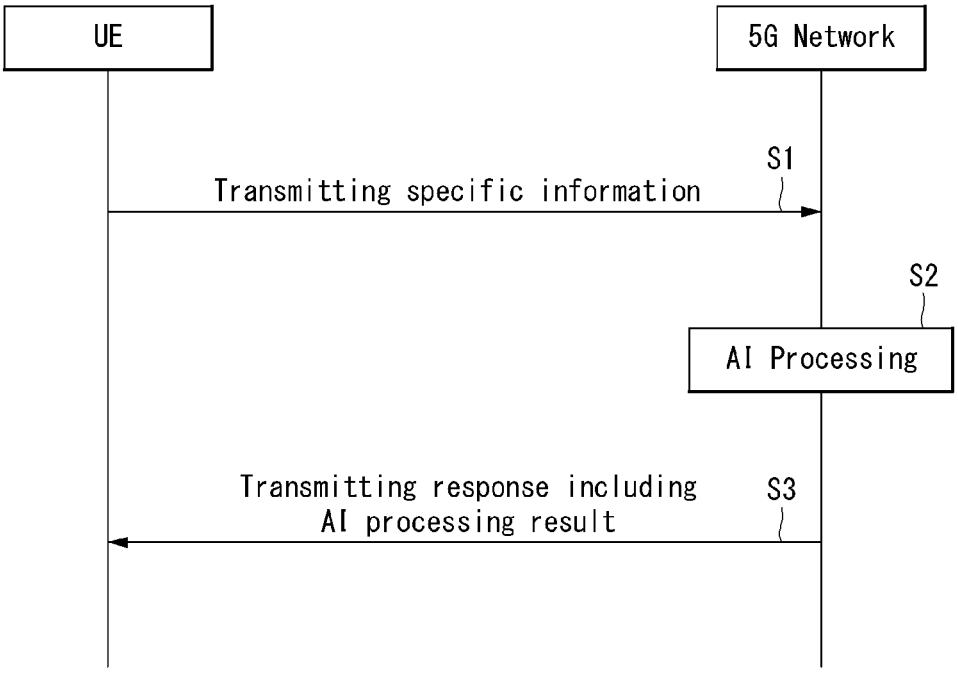
FIG. 3 shows an example of basic operations of an autonomous vehicle and a 5G network in a 5G communication system.

FIG. 3 shows an example of basic operations of a user equipment and a 5G network in a 5G communication system.

The user equipment transmits specific information to the 5G network (S1). The specific information may include autonomous driving related information. In addition, the 5G network can determine whether to remotely control the vehicle (S2). Here, the 5G network may include a server or a module which performs remote control related to autonomous driving. In addition, the 5G network can transmit information (or signal) related to remote control to the user equipment (S3).

G. Applied Operations Between User Equipment and 5G Network in 5G Communication System Hereinafter, the operation of a user equipment using 5G communication will be described in more detail with reference to wireless communication technology (BM procedure, URLLC, mMTC, etc.) described in FIGS. 1 and 2.

First, a basic procedure of an applied operation to which a method proposed by the present invention which will be described later and eMBB of 5G communication are applied will be described.

As in steps S1 and S3 of FIG. 3, the user equipment performs an initial access procedure and a random access procedure with the 5G network prior to step S1 of FIG. 3 in order to transmit/receive signals, information and the like to/from the 5G network.

More specifically, the user equipment performs an initial access procedure with the 5G network on the basis of an SSB in order to acquire DL synchronization and system information. A beam management (BM) procedure and a beam failure recovery procedure may be added in the initial access procedure, and quasi-co-location (QCL) relation may be added in a process in which the user equipment receives a signal from the 5G network.

In addition, the user equipment performs a random access procedure with the 5G network for UL synchronization acquisition and/or UL transmission. The 5G network can transmit, to the user equipment, a UL grant for scheduling transmission of specific information. Accordingly, the user equipment transmits the specific information to the 5G network on the basis of the UL grant. In addition, the 5G network transmits, to the user equipment, a DL grant for scheduling transmission of 5G processing results with respect to the specific information. Accordingly, the 5G network can transmit, to the user equipment, information (or a signal) related to remote control on the basis of the DL grant.

Next, a basic procedure of an applied operation to which a method proposed by the present invention which will be described later and URLLC of 5G communication are applied will be described.

As described above, a user equipment can receive DownlinkPreemption IE from the 5G network after the user equipment performs an initial access procedure and/or a random access procedure with the 5G network. Then, the user equipment receives DCI format 2_1 including a preemption indication from the 5G network on the basis of DownlinkPreemption IE. The user equipment does not perform (or expect or assume) reception of eMBB data in resources (PRBs and/or OFDM symbols) indicated by the preemption indication. Thereafter, when the user equipment needs to transmit specific information, the user equipment can receive a UL grant from the 5G network.

Next, a basic procedure of an applied operation to which a method proposed by the present invention which will be described later and mMTC of 5G communication are applied will be described.

Description will focus on parts in the steps of FIG. 3 which are changed according to application of mMTC.

In step S1 of FIG. 3, the user equipment receives a UL grant from the 5G network in order to transmit specific information to the 5G network. Here, the UL grant may include information on the number of repetitions of transmission of the specific information and the specific information may be repeatedly transmitted on the basis of the information on the number of repetitions. That is, the user equipment transmits the specific information to the 5G network on the basis of the UL grant. Repetitive transmission of the specific information may be performed through frequency hopping, the first transmission of the specific information may be performed in a first frequency resource, and the second transmission of the specific information may be performed in a second frequency resource. The specific information can be transmitted through a narrowband of 6 resource blocks (RBs) or 1 RB.

The above-described 5G communication technology can be combined with methods proposed in the present invention which will be described later and applied or can complement the methods proposed in the present invention to make technical features of the methods concrete and clear.

Figure 4:
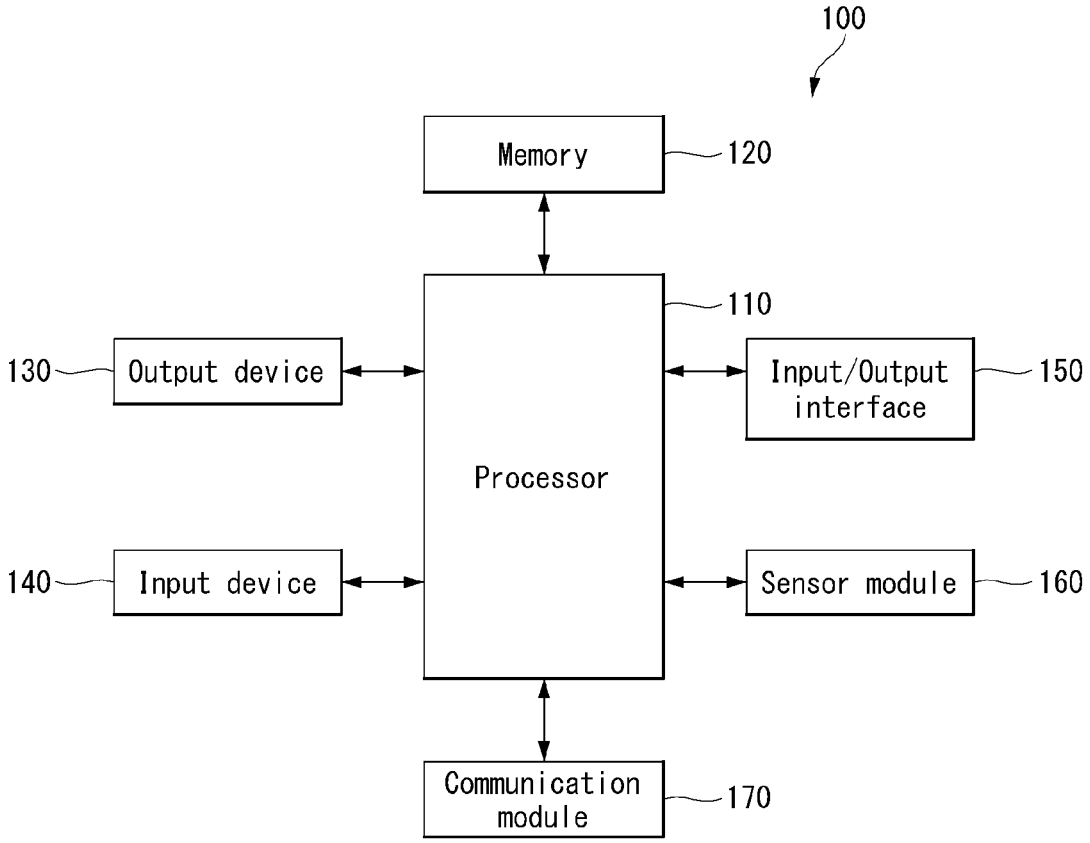
FIG. 4 is a diagram illustrating a block diagram of an electronic device.

FIG. 4 is a diagram illustrating a block diagram of an electronic device.

Referring to FIG. 4, an electronic device 100 may include at least one processor 110, a memory 120, an output device 130, an input device 140, an input/output interface 150, a sensor module 160, and a communication module 170.

The processor 110 may include one or more application processors (AP), one or more communication processors (CP), or at least one or more artificial intelligence processors (AI processors). The application processor, the communication processor, or the AI processor may be included in different integrated circuit (IC) packages, respectively, or may be included in one IC package.

The application processor may run an operating system or an application program to control a plurality of hardware or software components connected to the application processor, and perform various data processing/operations including multimedia data. As an example, the application processor may be implemented as a system on chip (SoC). The processor 110 may further include a graphic processing unit (GPU) (not shown).

The communication processor may perform functions of managing data links and converting a communication protocol in communication between the electronic device 100 and other electronic devices connected through a network. As an example, the communication processor may be implemented as an SoC. The communication processor may perform at least some of the multimedia control functions.

In addition, the communication processor may control data transmission and reception of the communication module 170. The communication processor may be implemented to be included as at least a part of the application processor.

The application processor or the communication processor may load and process a command or data received from at least one of a nonvolatile memory or other components connected to each to a volatile memory. Also, the application processor or the communication processor may store data received from at least one of the other components or generated by at least one of the other components in the nonvolatile memory.

The memory 120 may include an internal memory or an external memory. The internal memory may include at least one of the volatile memory (for example, dynamic RAM (DRAM), static RAM (SRAM), synchronous dynamic RAM (SDRAM), etc.) or the nonvolatile memory (for example, one time programmable ROM (OTPROM), programmable ROM (PROM), erasable and programmable ROM (EPROM), electrically erasable and programmable ROM (EEPROM), mask ROM, flash ROM, NAND flash memory, NOR flash memory, etc.). According to an embodiment, the internal memory may take the form of a solid state drive (SSD). The external memory may further include a flash drive, for example, compact flash (CF), secure digital (SD), micro secure digital (Micro-SD), mini secure digital (Mini-SD), and extreme digital (xD) or a memory stick, etc.

The output device 130 may include at least one or more of a display module and a speaker. The output device 130 may display various types of data including multimedia data, text data, voice data, and the like to a user or output it as sound.

The input device 140 may include a touch panel, a digital pen sensor, a key, or an ultrasonic input device, etc. For example, the input device 140 may be the input/output interface 150. The touch panel may recognize a touch input using at least one of a capacitive type, a pressure sensitive type, an infrared type, or an ultrasonic type. In addition, the touch panel may further include a controller (not shown). In the case of capacitive type, not only direct touch but also proximity recognition is possible. The touch panel may further include a tactile layer. In this case, the touch panel may provide a tactile reaction to the user.

The digital pen sensor may be implemented using the same or similar method as receiving a user's touch input, or using a separate recognition layer. Keys may be keypads or touch keys. The ultrasonic input device is a device that can check data by detecting a micro sound wave in a terminal through a pen that generates an ultrasonic signal, and is capable of wireless recognition. The electronic device 100 may receive a user input from an external device (e.g. a network, a computer, or a server) connected thereto by using the communication module 170.

The input device 140 may further include a camera module and a microphone. The camera module is a device capable of capturing images and moving pictures, and may include one or more image sensors, an image signal processor (ISP), or a flash LED. The microphone may receive an audio signal and convert it into an electrical signal.

The input/output interface 150 may transmit commands or data input from the user through the input device or the output device to the processor 110, the memory 120, the communication module 170, etc. through a bus (not shown). For example, the input/output interface 150 may provide data on a user's touch input entered through the touch panel to the processor 110. For example, the input/output interface 150 may output commands or data received from the processor 110, the memory 120, the communication module 170, etc. through the bus through the output device 130. For example, the input/output interface 150 may output voice data processed through the processor 110 to the user through the speaker.

The sensor module 160 may include at least one of a gesture sensor, a gyro sensor, an atmospheric pressure sensor, a magnetic sensor, an acceleration sensor, a grip sensor, a proximity sensor, an RGB (red, green, blue) sensor, a biometric sensor, a temperature/humidity sensor, an illuminance sensor and an ultra violet (UV) sensor. The sensor module 160 may measure a physical quantity or detect an operating state of the electronic device 100 and convert the measured or detected information into an electric signal. Additionally or alternatively, the sensor module 160 may include an olfactory sensor (E-nose sensor), an EMG sensor (electromyography sensor), an EEG sensor (electroencephalogram sensor, not shown), an ECG sensor (electrocardiogram sensor), a PPG sensor (photoplethysmography sensor), a heart rate monitor sensor (HRM), a perspiration sensor or a fingerprint sensor, etc. The sensor module 160 may further include a control circuit for controlling at least one or more sensors included therein.

The communication module 170 may include a wireless communication module or an RF module. The wireless communication module may include, for example, Wi-Fi, BT, GPS or NFC. For example, the wireless communication module may provide a wireless communication function using a radio frequency. Additionally or alternatively, the wireless communication module may include a network interface or modem for connecting the electronic device 100 to a network (example: internet, LAN, WAN, telecommunication network, cellular network, satellite network, POTS or 5G network, etc.).

The RF module may be responsible for transmission and reception of data, for example, transmission and reception of RF signals or called electronic signals. For example, the RF module may include a transceiver, a power amp module (PAM), a frequency filter or a low noise amplifier (LNA), etc. In addition, the RF module may further include components for transmitting and receiving an electromagnetic wave in a free space in wireless communication, for example, a conductor or a wire.

The electronic device 100 according to various embodiments of the present disclosure may include at least one of a server, a TV, a refrigerator, an oven, a clothing styler, a robot cleaner, a drone, an air conditioner, an air cleaner, a PC, a speaker, a home CCTV, a lighting, a washing machine and a smart plug. Since the components of the electronic device 100 described in FIG. 4 are examples of components generally included in the electronic device, the electronic device 100 according to the embodiment of the present disclosure is not limited to the above-described components, and may be omitted and/or added as necessary.

The electronic device 100 may perform an artificial intelligence-based control operation by receiving the AI processing result from the cloud environment shown in FIG.

5 or may include an AI module in which components related to the AI process are integrated into one module to perform AI processing in an on-device method.

Figure 5:
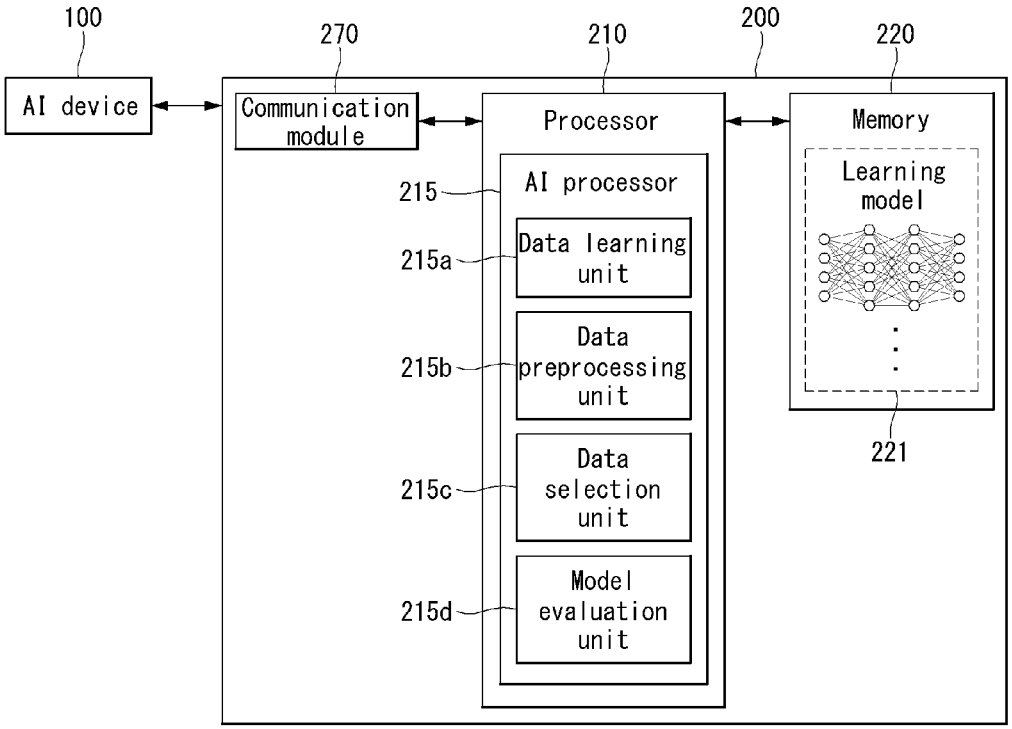
FIG. 5 illustrates a schematic block diagram of an AI server according to an embodiment of the present disclosure.

Hereinafter, an AI process performed in a device environment and/or a cloud environment or a server environment will be described through FIGS. 5 and 6. FIG. 5 illustrates an example in which receiving data or signals may be performed in the electronic device 100, but AI processing to process input data or signals may be performed in a cloud environment. In contrast, FIG. 6 illustrates an example of on-device processing in which the overall operation related to AI processing for input data or signals is performed in the electronic device 100.

Figure 6:
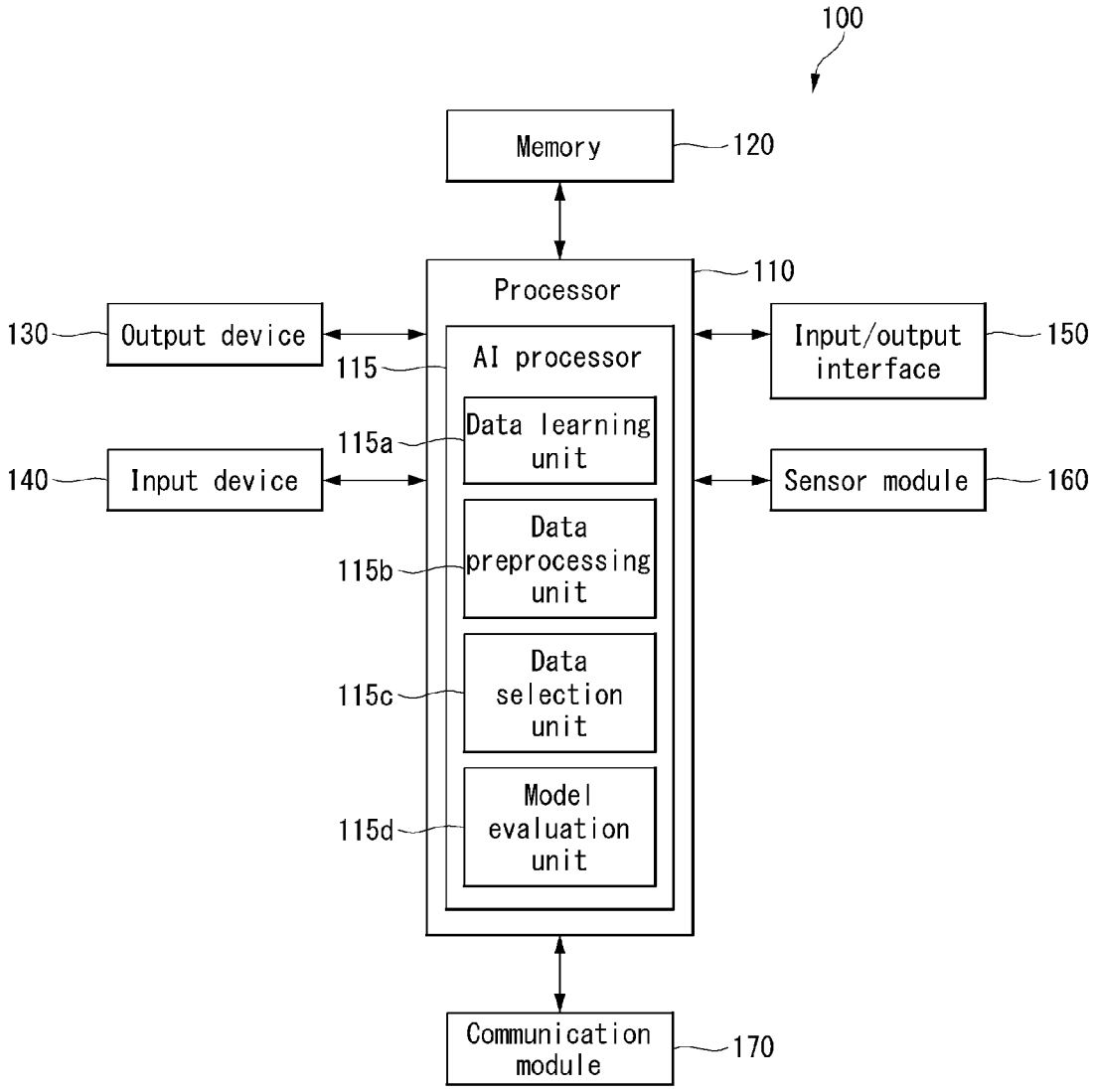
FIG. 6 illustrates a schematic block diagram of an AI device according to another embodiment of the present disclosure.

In FIGS. 5 and 6, the device environment may be referred to as 'client device' or 'AI device', and the cloud environment may be referred to as 'server' or 'AI server'.

FIG. 5 illustrates a schematic block diagram of an AI server according to an embodiment of the present disclosure.

A server 200 may include a processor 210, a memory 220, and a communication module 270.

An AI processor 215 may learn a neural network using a program stored in the memory 220. In particular, the AI processor 215 may learn a neural network for recognizing data related to an operation of an AI device 100. Here, the neural network may be designed to simulate a human brain structure (e.g. a neuron structure of a human neural network) on a computer. The neural network may include an input layer, an output layer, and at least one hidden layer. Each layer may include at least one neuron having a weight, and the neural network may include a synapse connecting neurons and neurons. In the neural network, each neuron may output an input signal input through the synapse as a function value of an activation function for weight and/or bias.

A plurality of network nodes may exchange data according to each connection relationship so that the neurons simulate synaptic activity of neurons that exchange signals through synapses. Here, the neural network may include a deep learning model developed from a neural network model. In the deep learning model, a plurality of network nodes may exchange data according to a convolutional connection relationship while being located in different layers. Examples of neural network models may include various deep learning techniques such as a deep neural network (DNN), a convolutional neural network (CNN), a recurrent neural network, a restricted Boltzmann machine, and a deep belief network, a deep Q-Network, and may be applied in fields such as vision recognition, speech recognition, natural language processing, and voice/signal processing.

Meanwhile, the processor 210 performing the functions as described above may be a general-purpose processor (e.g. a CPU), but may be an AI dedicated processor (e.g. a GPU) for artificial intelligence learning.

The memory 220 may store various programs and data required for the operation of the AI device 100 and/or the server 200. The memory 220 may be accessed by the AI processor 215, and may read/write/edit/delete/update data by the AI processor 215. In addition, the memory 220 may store a neural network model (e.g. a deep learning model) generated through a learning algorithm for data classification/recognition according to an embodiment of the present disclosure. Furthermore, the memory 220 may store not only the learning model 221 but also input data, learning data, and learning history, etc.

Meanwhile, the AI processor 215 may include a data learning unit 215*a* for learning a neural network for data classification/recognition. The data learning unit 215*a* may learn a criterion for which learning data to use in order to determine data classification/recognition and how to classify and recognize data using the learning data. The data learning unit 215*a* may learn the deep learning model by acquiring learning data to be used for learning and applying the acquired learning data to the deep learning model.

The data learning unit 215*a* may be manufactured in the form of at least one hardware chip and mounted on the server 200. For example, the data learning unit 215*a* may be manufactured in the form of a dedicated hardware chip for artificial intelligence, and may be manufactured as a part of a general-purpose processor (CPU) or a graphics dedicated processor (GPU) and mounted on the server 200. Further, the data learning unit 215*a* may be implemented as a software module. When implemented as a software module (or a program module including an instruction), the software module may be stored in a computer-readable non-transitory computer readable media. In this case, at least one software module may be provided to an operating system (OS) or may be provided by an application.

The data learning unit 215*a* may learn to have a criterion for determining how a neural network model classifies/recognizes predetermined data using the acquired learning data. In this case, the learning method by the model learning unit may be classified into supervised learning, unsupervised learning, and reinforcement learning. Here, the supervised learning may refer to a method of learning an artificial neural network in a state where a label for learning data is given, and the label may mean a correct answer (or result value) that the artificial neural network must infer when the learning data is input to the artificial neural network. The unsupervised learning may mean a method of learning an artificial neural network in a state where a label for learning data is not given. The reinforcement learning may mean a method in which an agent defined in a specific environment learns to select an action or action sequence that maximizes the cumulative reward in each state. In addition, the model learning unit may learn the neural network model using a learning algorithm including an error backpropagation method or a gradient decent method. When the neural network model is learned, the learned neural network model may be referred to as a learning model 221. The learning model 221 may be stored in the memory 220 and used to infer a result of new input data other than the learning data.

On the other hand, in order to improve the analysis results using the learning model 221, or to save resources or time required for the generation of the learning model 221, the AI processor 215 may further include a data preprocessing unit 215*b* and/or a data selection unit 215*c*.

The data preprocessing unit 215*b* may preprocess the acquired data so that the acquired data can be used for learning/inference for determining a situation. For example, the data preprocessing unit 215*b* may extract feature information as preprocessing for input data acquired through the input device, and the feature information may be extracted in a format such as a feature vector, a feature point, or a feature map.

The data selection unit 215*c* may select data necessary for learning among learning data or learning data preprocessed in the preprocessing unit. The selected learning data may be provided to the model learning unit. As an example, the data selection unit 215*c* may select only data on an object included in a specific region as learning data by detecting the specific region among images acquired through a camera of the electronic device. In addition, the data selection unit 215*c* may select data necessary for inference among input data acquired through the input device or input data preprocessed by the preprocessing unit.

In addition, the AI processor 215 may further include a model evaluation unit 215*d* to improve the analysis result of the neural network model. When the model evaluation unit 215*d* inputs evaluation data to the neural network model and the analysis result output from the evaluation data does not satisfy a predetermined criterion, the model evaluation unit 215*d* may cause the model learning unit to relearn. In this case, the evaluation data may be predetermined data for evaluating the learning model 221. As an example, among the analysis results of the learned neural network model for evaluation data, when the number or ratio of evaluation data with inaccurate analysis results exceeds a predetermined threshold, the model evaluation unit 215*d* may evaluate that the predetermined criterion is not satisfied.

The communication module 270 may transmit the AI processing result by the AI processor 215 to an external electronic device.

In FIG. 5 above, it has been described that an example in which an AI process is implemented in a cloud environment due to computing operation, storage, and power constraints, but the present disclosure is not limited thereto, and the AI processor 215 may be implemented in a client device. FIG. 6 is an example in which AI processing is implemented in the client device, and is the same as illustrated in FIG. 5 except that the AI processor 215 is included in the client device.

FIG. 6 illustrates a schematic block diagram of an AI device according to another embodiment of the present disclosure.

The function of each configuration shown in FIG. 6 may refer to FIG. 5. However, since the AI processor is included in the client device 100, it may not be necessary to communicate with the server (200 in FIG. 5) in performing processes such as data classification/recognition, and accordingly, immediate or real-time data classification/recognition operation is possible. In addition, since there is no need to transmit the user's personal information to the server (200 in FIG. 5), the data classification/recognition operation for the purpose is possible without external leakage of the personal information.

On the other hand, each of the components shown in FIGS. 5 and 6 represents functional elements that are functionally divided, and it is noted that at least one component may be implemented in a form that is integrated with each other (e.g. an AI module) in an actual physical environment. It goes without saying that components not disclosed in addition to the plurality of components illustrated in FIGS. 5 and 6 may be included or omitted.

Figure 7:
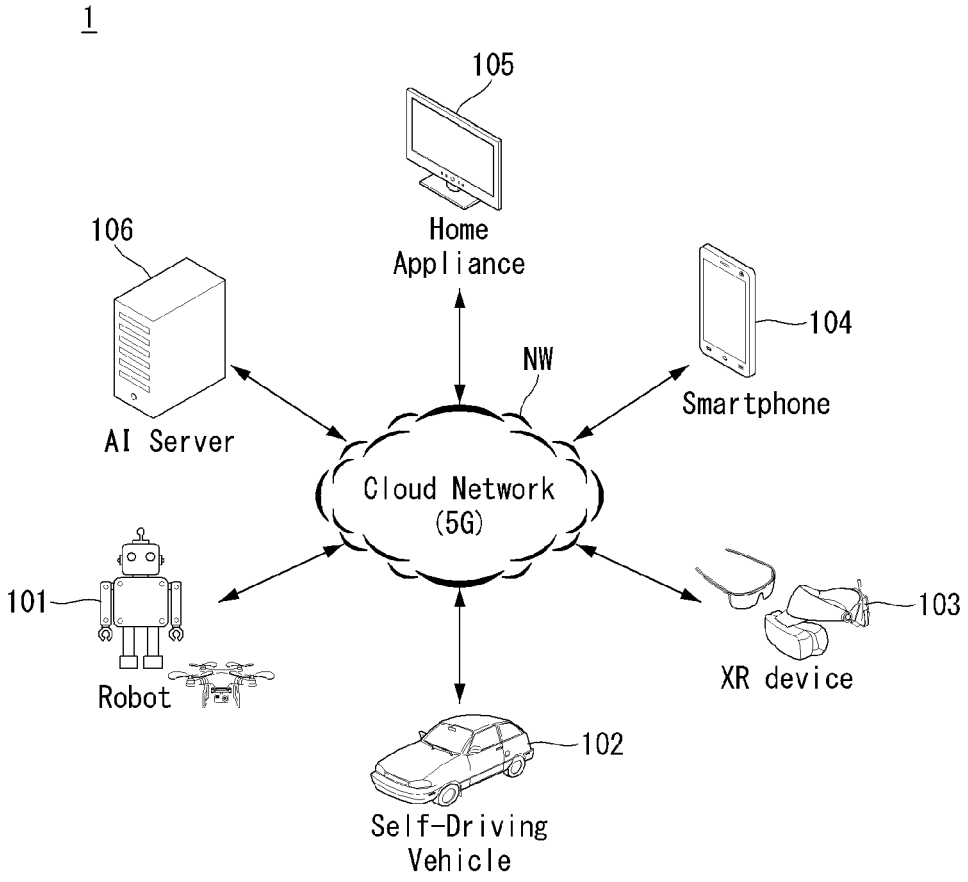
FIG. 7 is a conceptual diagram illustrating an embodiment of an AI device.

FIG. 7 is a conceptual diagram illustrating an embodiment of an AI device.

Referring to FIG. 7, in an AI system 1, at least one of an AI server 106, a robot 101, a self-driving vehicle 102, an XR device 103, a smartphone 104, or a home appliance 105 are connected to a cloud network NW. Here, the robot 101, the self-driving vehicle 102, the XR device 103, the smartphone 104, or the home appliance 105 applied with the AI technology may be referred to as the AI devices 101 to 105.

The cloud network NW may mean a network that forms a part of a cloud computing infrastructure or exists in the cloud computing infrastructure. Here, the cloud network NW may be configured using the 3G network, the 4G or the Long Term Evolution (LTE) network, or the 5G network.

That is, each of the devices 101 to 106 constituting the AI system 1 may be connected to each other through the cloud network NW. In particular, each of the devices 101 to 106 may communicate with each other through a base station, but may communicate directly with each other without going through the base station.

The AI server 106 may include a server performing AI processing and a server performing operations on big data.

The AI server 106 may be connected to at least one of the robots 101, the self-driving vehicle 102, the XR device 103, the smartphone 104, or the home appliance 105, which are AI devices constituting the AI system, through the cloud network NW, and may assist at least some of the AI processing of the connected AI devices 101 to 105.

At this time, the AI server 106 may learn the artificial neural network according to the machine learning algorithm on behalf of the AI devices 101 to 105, and directly store the learning model or transmit it to the AI devices 101 to 105.

At this time, the AI server 106 may receive input data from the AI devices 101 to 105, infer a result value for the received input data using the learning model, generate a response or a control command based on the inferred result value and transmit it to the AI devices 101 to 105.

Alternatively, the AI devices 101 to 105 may infer the result value for the input data directly using the learning model, and generate a response or a control command based on the inferred result value.

In the following disclosure, a method and device of inspecting a sound input/output device using an AI server, an AI device, or an AI system including the AI server and the AI device will be described.

Figure 8:
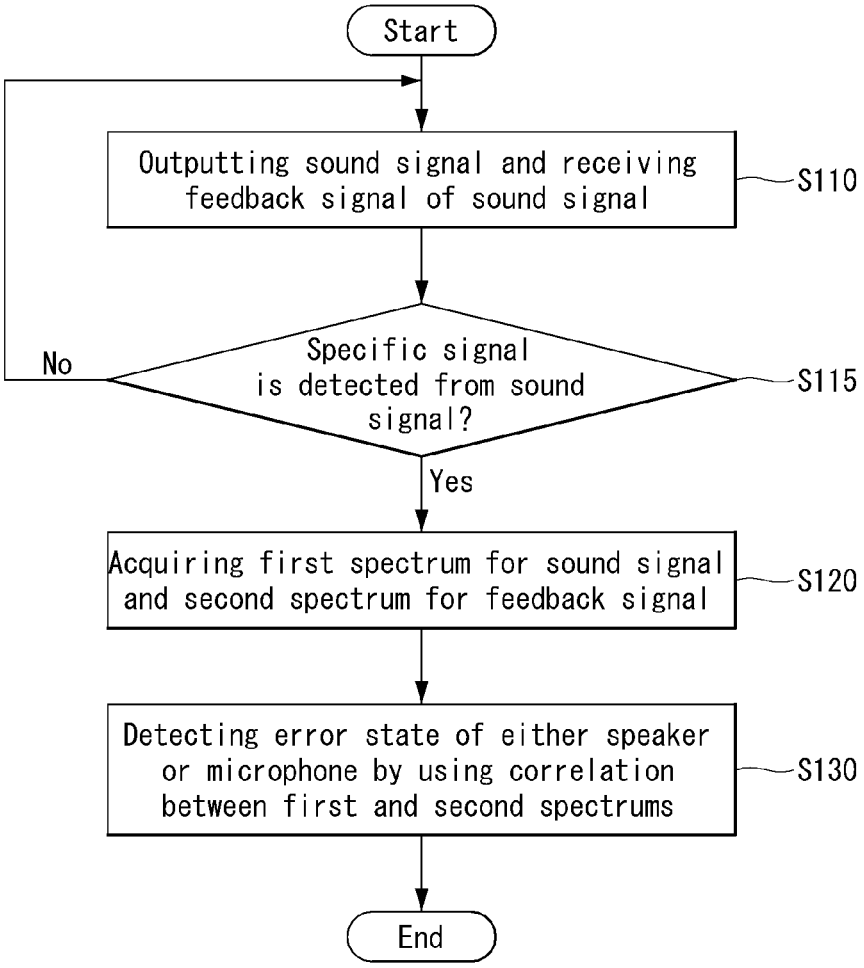
FIG. 8 is a schematic flowchart of a method of inspecting a sound input/output device according to an embodiment of the present disclosure.

FIG. 8 is a schematic flowchart of a method of inspecting a sound input/output device according to an embodiment of the present disclosure.

The AI device 100 may output a sound signal through a speaker, and receive a feedback signal of the sound signal through a microphone (S110). Here, the sound signal and/or the feedback signal may be multitone sound waves composed of a linear sum of sinusoidal waves having a plurality of frequency components. The feedback signal may be a reflection signal for the sound signal and may have properties similar to those of the sound signal. Meanwhile, the processor 110 may remove noise and perform filtering and sampling for the sound signal input through the microphone.

In the inspection method according to various embodiments of the present disclosure, when the AI device 100 includes a plurality of speakers, the processor 110 may diagnose the state of each speaker by controlling the plurality of speakers to sequentially output sound. In this case, since the plurality of speakers are disposed at different positions and the distance between each speaker and the microphone may be different, the processor 110 may set and output different volume according to the distance between the microphone and each speaker.

When at least one specific signal for inspecting performance of the speaker or the microphone is detected from the sound signal, the AI device 100 may acquire a first spectrum for the sound signal and a second spectrum for the feedback signal (S115: YES, S120). In various embodiments of the present disclosure, the data to be calculated for a cross-correlation coefficient is not limited to the spectrum, and may be similarly implemented using a spectrogram. The spectrogram is a tool for visualizing and grasping sound or waves, and a combination of waveform and spectrum characteristics. In the waveform, a change in amplitude according to a change in time can be seen, and in the spectrum, a change in amplitude according to a change in frequency can be confirmed. The difference in amplitude in the spectrogram appears as a difference in print density and/or display color as the time axis and frequency axis change.

The AI device 100 may detect an error state of either the speaker or the microphone by using a correlation between the first and second spectrums (S130). At this time, the processor 110 may calculate the cross-correlation coefficient between the first and second spectrums, and detect an error state of any one of the speaker and/or the microphone by comparing the cross-correlation coefficient with a predetermined threshold. The contents related to the calculation of the cross-correlation coefficient are obvious to those skilled in the art and will be omitted. Meanwhile, specific details related to the detection of the error state will be described later in FIGS. 10A and 10B.

In an embodiment of the present disclosure, an analysis section for monitoring an input/output device may be determined by comparing the cross-correlation coefficient with a predetermined reference value. Here, the analysis section may be determined as a section between a plurality of reference points having the cross-correlation coefficient equal to or greater than the predetermined reference value. As such, the analysis section determined as the section between the plurality of reference points having the cross-correlation coefficient equal to or greater than the predetermined reference value may be referred to as an error analysis section.

Figure 9:
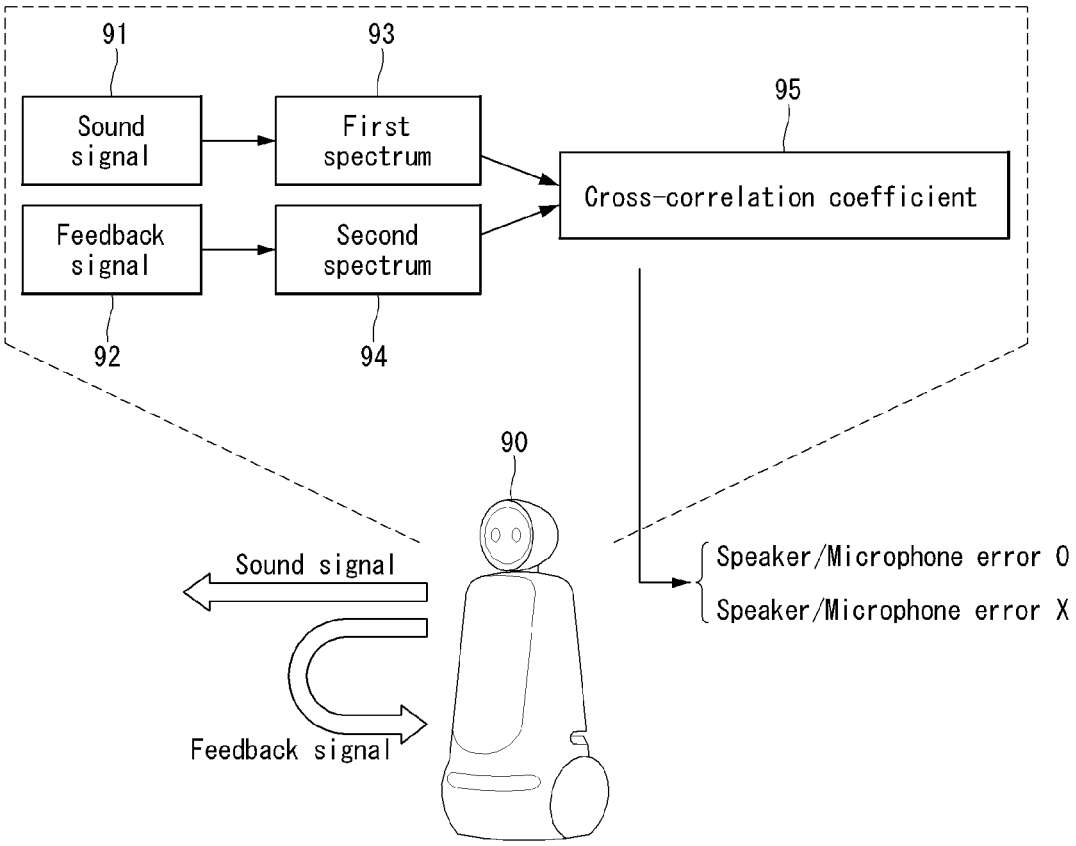
FIG. 9 is a diagram for explaining an embodiment of an inspection method shown in FIG. 8.

FIG. 9 is a diagram for explaining an embodiment of an inspection method shown in FIG. 8.

Referring to FIG. 9, an AI device 90 may output a sound signal through a speaker and receive the output sound signal again through a microphone. In this case, the signal received through the microphone is a feedback signal for the output sound signal.

As shown in FIG. 9, the AI device 90 may receive the sound signal output through the speaker through the microphone, but for effective testing, the AI device 90 may perform the test by driving in an environment in which the signal output through the speaker can be smoothly input.

The AI device 90 may acquire first and second spectrums, respectively, using the sound signal and the feedback signal. As described above in FIG. 8, the AI device 90 may detect an error state of any one of the speaker or the microphone provided in the AI device 90 by using the correlation between the first and second spectrums. Meanwhile, the process of detecting the error state of either the speaker or the microphone may be performed in the AI device 90, but is not limited thereto and may be performed in an external server capable of communicating with the AI device 90.

The AI device 90 applied to an embodiment of the present disclosure may be an airport robot or an autonomous vehicle, but is not limited thereto. In the following disclosure, the description is based on the airport robot, but it may be applied to the autonomous vehicle as well.

Figure 10A:
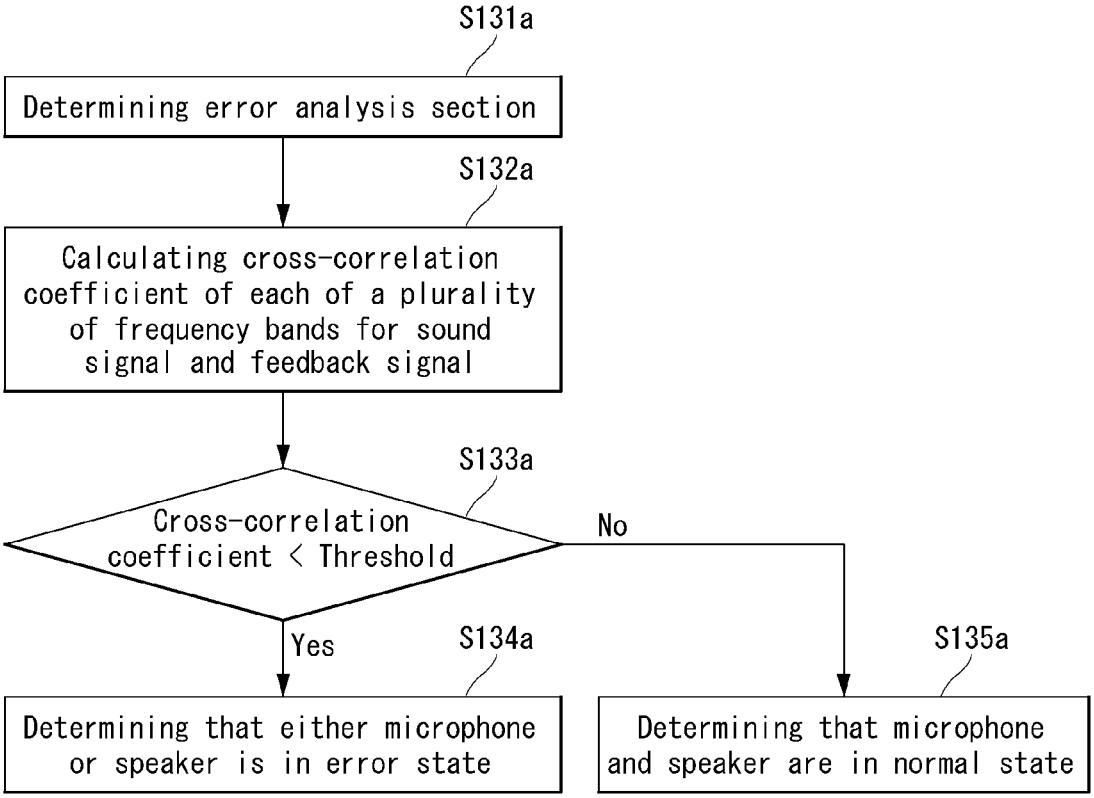
FIGS. 10A and 10B are flowcharts illustrating an error detection method of a sound input/output device of S130.
Figure 10B:
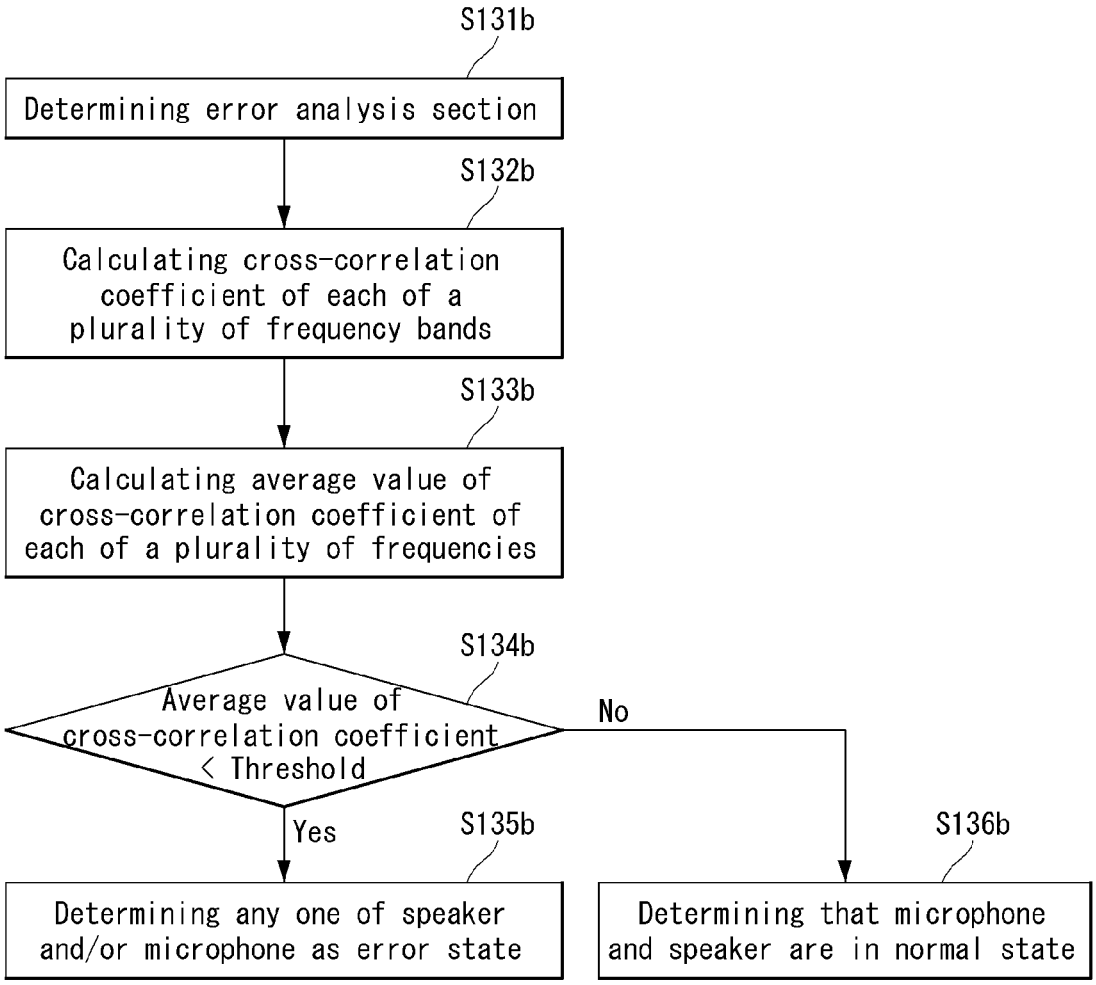

FIGS. 10A and 10B are flowcharts illustrating an error detection method of a sound input/output device of S130.

The error analysis section in FIG. 10A may be determined as a section between a plurality of reference points having a cross-correlation coefficient equal to or greater than a predetermined reference value as described above in FIG. 8 (S131*a*).

Referring to FIG. 10A, the processor 110 may calculate a cross-correlation coefficient of each of a plurality of frequency bands for the sound signal and the feedback signal (S132*a*).

On the other hand, when the cross-correlation coefficient of each of the plurality of frequency bands is less than a predetermined threshold, the processor 110 may determine that either the microphone or the speaker is in an error state (S133*a*: YES, S134*a*). In this case, the plurality of frequency bands includes each frequency of sinusoidal waves having a plurality of frequency components included in the sound signal and the feedback signal. Time and frequency information for the sound signal and the feedback signal may be derived by a short-time-fourier transform (STFT), but is not limited thereto.

On the other hand, the processor 110 may determine that the microphone and the speaker are in a normal state when the cross-correlation coefficient of each of the plurality of frequency bands is greater than or equal to the predetermined threshold (S133*a*: NO, S135*a*).

As such, the processor 110 compares the cross-correlation coefficients of each of the plurality of frequency bands to check the performance of the speaker and/or microphone for various frequencies that can be used for the voice recognition function, and then may improve the accuracy of the operation of the AI device 100 regarding speech processing.

Referring to FIG. 10B, as described above in FIG. 8, the error analysis section may be determined as a section between a plurality of reference points having the cross-correlation coefficient equal to or greater than the predetermined reference value (S131*b*).

The processor 110 may calculate a cross-correlation coefficient of each of a plurality of frequency bands (S132*b*).

The processor 110 may calculate an average value of a cross-correlation coefficient of each of a plurality of frequencies (S133*b*).

The processor 110 may determine any one of the speaker and/or microphone as an error state when the average value of the cross-correlation coefficient of each of the plurality of frequencies is less than a predetermined threshold (S134*b*: YES, S135*b*).

Meanwhile, the processor 110 may determine that the microphone and the speaker are in a normal state when the average value of the cross-correlation coefficient of each of the plurality of frequency bands is greater than or equal to the predetermined threshold (S134*b*: NO, S136*b*).

In addition, the error detection method according to various embodiments of the present disclosure, by not only using the average value of the cross-correlation coefficient but also comparing each cross-correlation coefficient corresponding to the plurality of frequency bands with at least one threshold, may determine either the speaker and/or the microphone as an error state (see FIG. 10A). In the case of detecting the error state using the average value, it is possible to save resources consumed in comparison or operation processing, but since there may be cases where it is important to detect the error state for any one of a plurality of frequencies that is the primary purpose, the processor 110 may selectively use or simultaneously use both embodiments according to the user's setting.

Figure 11:
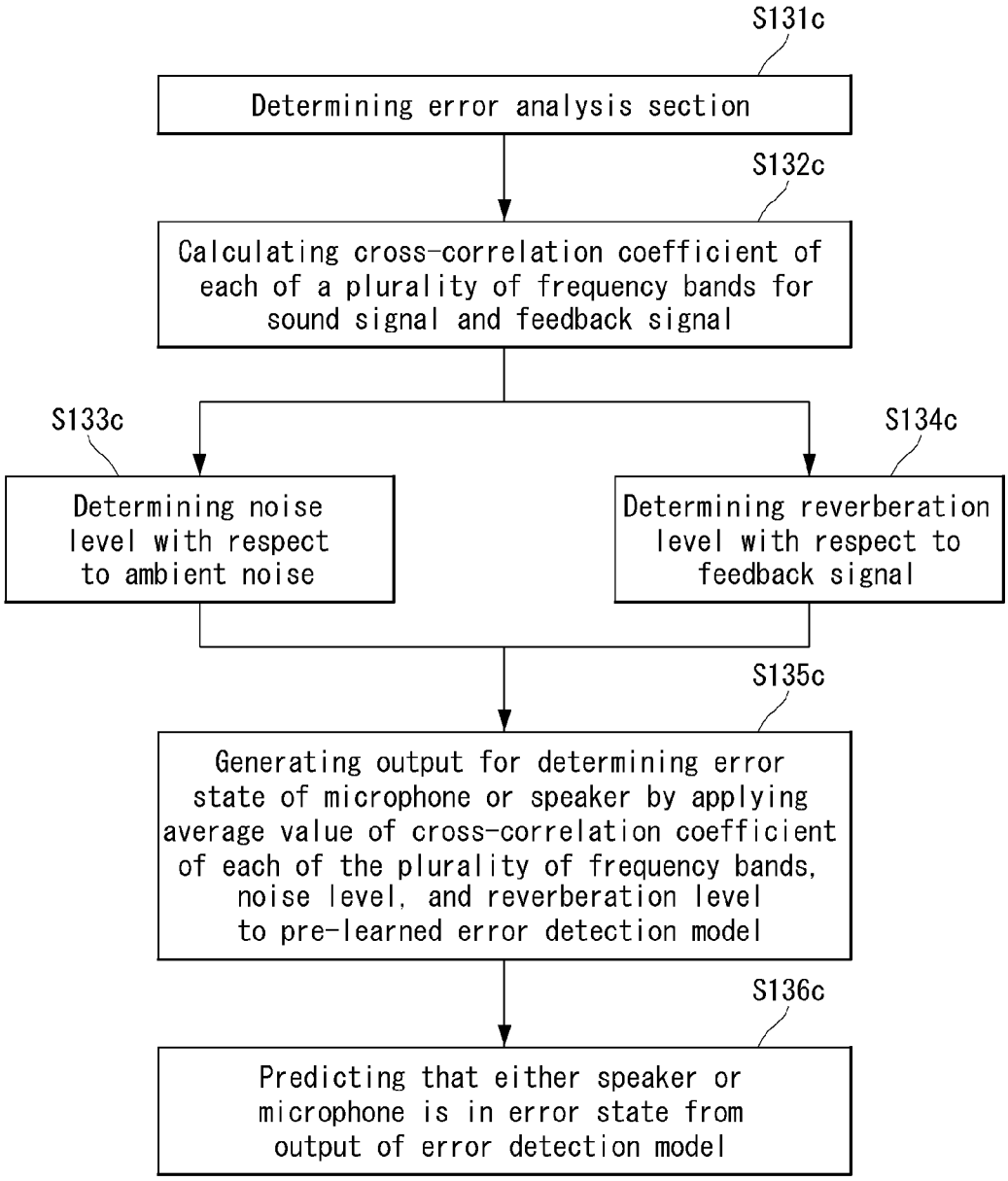
FIG. 11 is a flowchart illustrating an error detection method of a sound input/output device using a learning model of S130.

FIG. 11 is a flowchart illustrating an error detection method of a sound input/output device using a learning model of S130.

Unlike the description of FIGS. 10A and 10B, an embodiment of the present disclosure shown in FIG. 11 uses a learning model (LM) based on an artificial neural network (ANN) to implement a strong inspecting method for an ambient noise level and a reverberation level of sound. The learning model applied to an embodiment of the present disclosure may be a deep learning model (DLM) that has been learned with specific values for the ambient noise level, the reverberation level of sound, and the cross-correlation coefficient. Hereinafter, an error detection method of the sound input/output device using the deep learning model will be described with reference to FIG. 11.

As described above in FIG. 8, the processor 110 may determine a section between a plurality of reference points having a cross-correlation coefficient equal to or greater than a predetermined reference value as an error analysis section (S131*c*).

The processor 110 may calculate a cross-correlation coefficient of each of a plurality of frequency bands for the sound signal and the feedback signal (S132*c*).

The processor 110 may determine a noise level with respect to ambient noise and determine a reverberation level with respect to the feedback signal (S133*c* and S134*c*). The AI device 100 may receive ambient noise through the microphone and may determine a noise level according to the volume of the received noise, but is not limited thereto. The AI device 100 may determine a reverberation level by detecting reverberation included in the feedback signal. The reverberation effect is caused by the acoustic environment between the speaker's vocal position and the microphone, and its degree varies depending on spatial characteristics (acoustic impulse response). Here, the reverberation level represents the degree of reverberation that occurs due to the spatial characteristics. As an example, the reverberation level may extract a feature vector representing the spatial characteristics from the sound signal received from the microphone, and estimate the degree of reverberation using the feature vector representing the spatial characteristics and the artificial neural network, but is not limited thereto.

The processor 110 may generate an output for determining an error state of the microphone or speaker by applying an average value of the cross-correlation coefficient of each of the plurality of frequency bands, the noise level, and the reverberation level to a pre-learned error detection model (S135*c*). Here, the output may be a format of a probability value corresponding to at least one class of the error detection model. Here, the error detection model may be an artificial neural network-based learning model. The error detection model may be an artificial neural network-based learning model supervised learning by voice data including a plurality of cross-correlation coefficient values, noise levels and/or reverberation levels, and data labeled on the voice data, but is not limited thereto. The learning of the error detection model may not only be used by receiving the model learned in the AI server 200 for generating the learning model by the AI device 100 and storing it in a memory, but also perform a learning and generation process in the AI device 100. In addition, the weight of the error detection model may be learned to be set differently according to the ambient noise level and/or reverberation level.

The processor 110 may predict that either the speaker or the microphone is in an error state from the output of the error detection model (S136*c*).

In this way, when the error detection model is used, reliability of error determination in an environment in which background noise or reverberation is severe may be improved.

Figure 12:
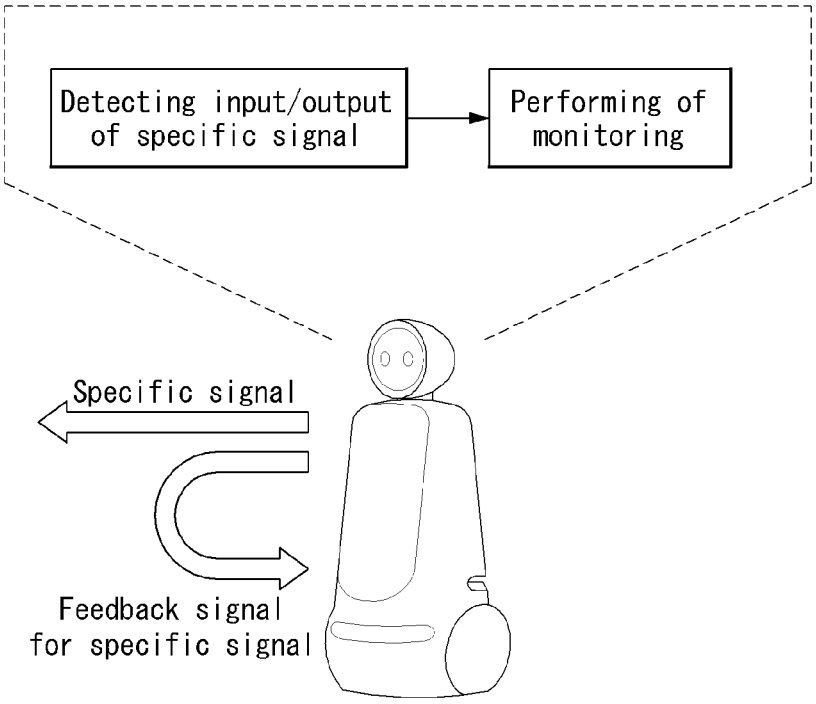
FIG. 12 is a diagram for describing a specific signal used in an embodiment of the present disclosure.

FIG. 12 is a diagram for describing a specific signal used in an embodiment of the present disclosure.

Referring to FIG. 12, the AI device 100 may output a specific signal through the speaker and start monitoring of the sound input/output device in response to an input of the feedback signal for the specific signal. In this case, the specific signal is a sound signal set to best identify the performance of the microphone or speaker applied to various AI devices 100 during the development process of the AI device 100. The specific signal may be naturally output while a user uses the AI device 100, and in an embodiment, the AI device 100 may perform monitoring of the sound input/output device only while the specific signal is input/output. In addition, the specific signal may include at least two signals instead of one.

For example, the specific signal may be a voice signal including a wake-up word or wake-up sentence or a voice signal for the wake-up word. Here, the specific signal may be a wake-up word having a frequency characteristic and/or a signal length that can best be identified by a speaker or a microphone provided in the AI device 100. In this case, the wake-up word may be "Hi, LG", but is not limited thereto.

As another example, the specific signal may be a buzzer signal other than a voice in the form of speech. Here, as described above, the buzzer signal may be a signal having a frequency characteristic and/or a signal length that can best be identified by the speaker or microphone provided in the AI device 100.

As another example, the specific signal may be a single-tone sinusoidal signal that is not generated in a general environment. In this case, an inspection signal may store a plurality of single-tone sinusoidal signals having different frequencies. A single-tone sine wave signal that is not generated in the general environment may be distinguished from a noise in a surrounding environment.

On the other hand, the specific signal may not be output for a long time according to various factors such as a user of the AI device 100, a usage environment, and the like. In an embodiment of the present disclosure, the processor 110 may perform sound input/output monitoring in response to input/output of a general signal other than the specific signal. In this case, the processor 110 may acquire first and second spectrums corresponding to input/output signals of a general sound signal, and detect an error state of either the speaker or the microphone by using a correlation between the acquired first and second spectrums.

However, in this case, since the monitoring process is performed as always-on monitoring, there may be a problem that a lot of evening and/or resource are consumed.

Thus, in an embodiment of the present disclosure, the processor 110 may search for a voice recognition scenario of the AI device 100 recorded during a predetermined period, and add a signal having a high output frequency to a specific signal from the search result. As a result, even if the voice recognition scenario including at least one predetermined specific signal is not performed, the AI device 100 may monitor the sound input/output device at an appropriate period according to the usage environment of the AI device 100 and the usage pattern of the user, etc. Here, the predetermined period may be predetermined in various time units such as a day, a week, or a month, and is not limited to the above example.

As an example, the AI device 100 may search for a voice recognition scenario of the AI device 100 recorded during a predetermined period of one month. As a result of the search, the AI device 100 may add a spoken sentence that the AI device 100 responded 10 or more times during a month and voice information on the spoken sentence to a database storing a specific signal.

On the other hand, different results may be derived according to the monitoring environment in the method of inspecting the sound input/output device according to various embodiments of the present disclosure. For example, a result derived from an environment having a high degree of noise or reverberation may have a relatively low reliability compared to a clean environment from noise or reverberation. Hereinafter, the control operation of the AI device 100 related to the monitoring environment in FIGS. 13A and 13B will be described later.

Figure 13A:
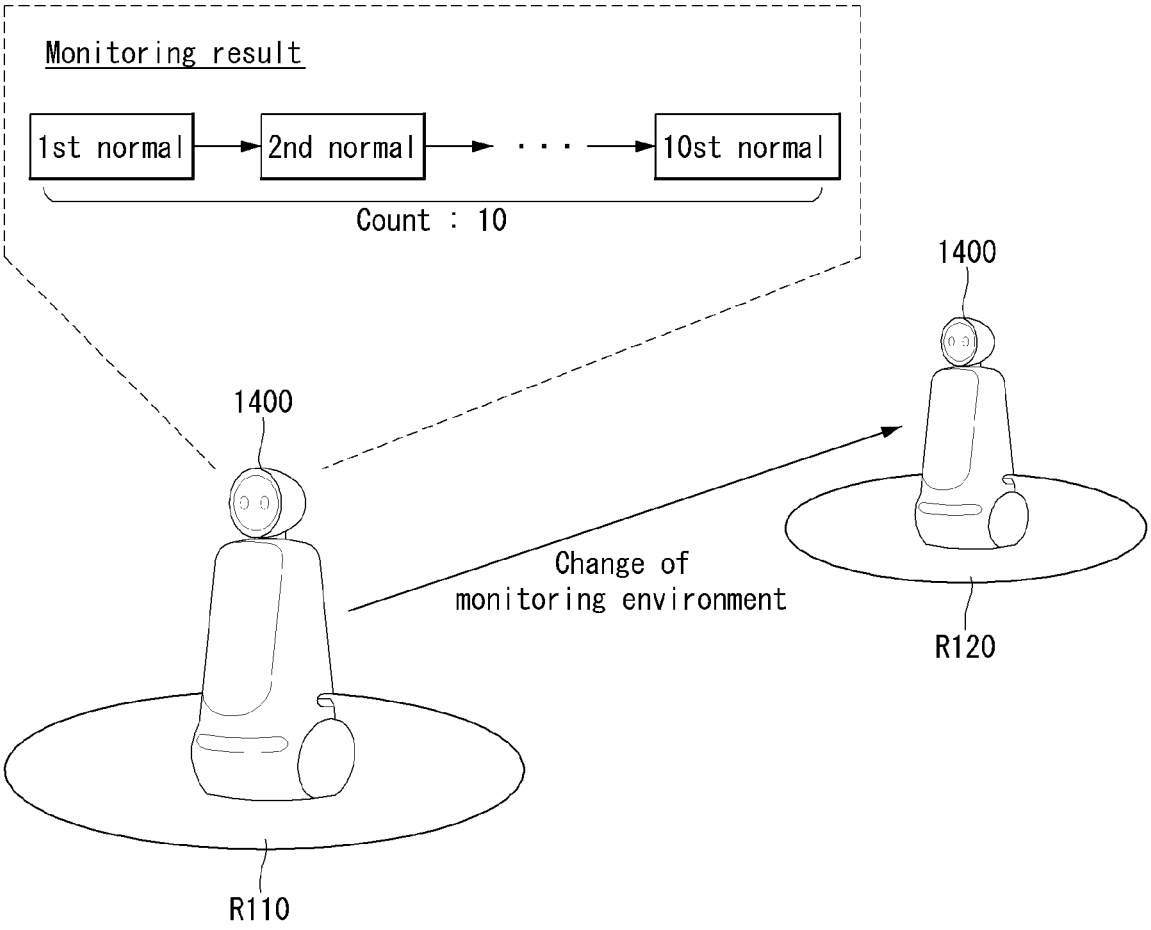
FIGS. 13A and 13B are diagrams for explaining a method of changing a monitoring environment according to an embodiment of the present disclosure.
Figure 13B:
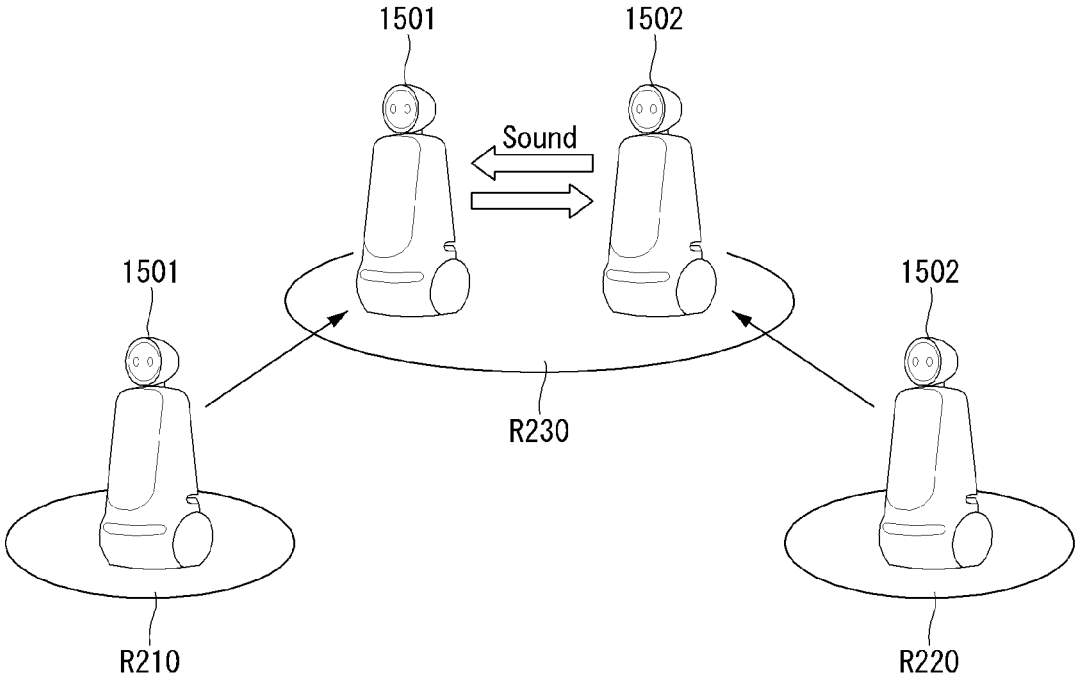

FIGS. 13A and 13B are diagrams for explaining a method of changing a monitoring environment according to an embodiment of the present disclosure.

Referring to FIG. 13A, the AI device 1400 may repeat the sound input/output process several times during a certain period in a specific environment. At this time, if the monitoring result is repeatedly determined to be normal or abnormal in one place, the determination result may be a result of a false determination due to other factors around it, so it may be necessary to move to an environment with high determination reliability and perform a monitoring process.

The processor 110 may search a history of detection of an error state according to an input/output signal of sound. In this case, log data including a performance time, a performance place, or a performance period of the detection of the error state may be recorded in the AI device 1400 or the server 200 capable of communicating with the AI device 1400.

When the same detection result is repeated more than a predetermined number of times, the processor 110 may generate a signal for controlling the AI device 1400 having a sound input/output device to travel to a designated place. Specifically, the processor 110 may control to change the monitoring environment of the AI device 1400 when the same determination result is repeatedly derived for a certain number of times or more for a certain period by analyzing the history of the detection of the error state. As an example, as a result of analyzing log data related to inspection of the input/output device for a week, if it is determined that the sound input/output device of the AI device 1400 is in an error state by repeating 10 or more times, the processor 110 may control to move from a first place R110 from which the results of the 10 repeated inspections are derived to a second place R120, which is a clean environment with high accuracy of determination to change the monitoring environment of the AI device 1400. In this case, the AI device 1400 may be an airport robot having a driving function, but is not limited thereto.

Referring to FIG. 13B, the AI devices 1501 and 1502 may repeat the sound input/output process several times for a certain period in a specific environment. In this case, at least one of the AI devices 1501 and 1502 may pre-store information on a specific signal set in advance in the design stage in the memory of the AI devices 1501 and 1502. Therefore, for accurate diagnosis of the AI devices 1501 and 1502, at least one AI device 1501, 1502 that has undergone the same design process is gathered in a group unit at a designated place to perform monitoring of the aforementioned sound input/output device. As an example, when the same detection result is repeated more than a predetermined number of times with respect to error state detection as in FIG. 13A, the processor 110 may generate a signal for controlling the AI devices 1501 and 1502 equipped with the sound input/output device to travel to a designated place. As another example, when the same detection result is repeated more than a predetermined number of times with respect to the error state detection of the AI devices 1501 and 1502, the server 200 may transmit a signal for controlling the AI devices 1501 and 1502 equipped with the sound input/output device to travel to a designated place to the AI devices 1501 and 1502.

In this way, the AI devices 1501 and 1502 may detect an error of either a microphone or a speaker by gathering at a specific location 8230 in an existing location R210 and R220 according to the AI device's own determination result or the server's communication control, sequentially inputting and outputting a predetermined specific signal by the gathered at least one AI device 1501, 1502, and analyzing the input and output signals. In this way, by gathering at least one AI device 1501, 1502 in a specific place and detecting an error of the sound input/output device in a clustered state, the method of inspecting the sound input/output device according to an embodiment may derive a result with relatively high reliability compared to repeatedly inspecting errors in only one device.

The above-described embodiments of the present disclosure have been described focusing on on-device processing, but are not limited thereto, and the AI processing may be performed in the server 200 (e.g. an AI server) as well as the AI device 100 including the aerial robot. Hereinafter, a system for monitoring a sound input/output device including the server 200 and the AI device 100 will be described in FIG. 14.

Figure 14:
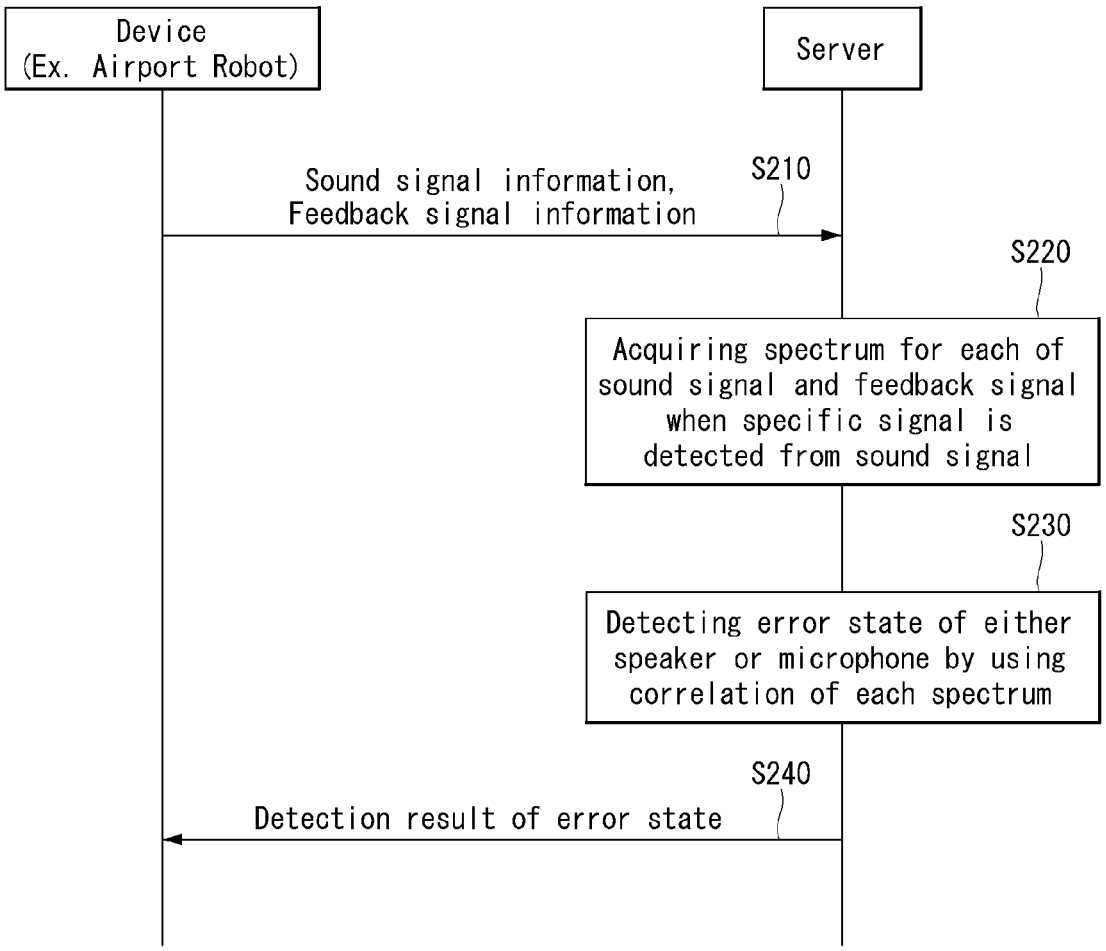
FIG. 14 is a sequence diagram of a method of inspecting a sound input/output device according to another embodiment of the present disclosure.

FIG. 14 is a sequence diagram of a method of inspecting a sound input/output device according to another embodiment of the present disclosure.

Referring to FIG. 14, an external device may output a sound signal, receive a feedback signal for the output sound signal, and generate information on each signal (S210).

The server 200 may receive sound signal information output from the external device and feedback signal information on the output sound signal from the external device (S220). Here, the external device may refer to various AI devices 100, and the AI device 100 may include an aerial robot, an autonomous vehicle, and the like.

When at least one specific signal for inspecting performance of a speaker or microphone is detected from the sound signal information, the server 200 may acquire a first spectrum for the sound signal and a second spectrum for the feedback signal (S220).

The server 200 may detect an error state of either the speaker or the microphone by using a correlation between the first and second spectrums (S230).

The server 200 may transmit the detection result of the error state to the external device (S240). In this case, the device determined to be in an error state may display an image indicating that the device is in error through a display. The image may be displayed in various formats such as an emoticon, at least one color, and a character.

Meanwhile, the above-described method of inspecting the sound input/output device may be implemented as a readable recording medium in which a program for implementing all the above-described embodiments is recorded.

The above-described present disclosure can be implemented as a computer-readable code on a medium on which a program is recorded. The computer readable medium includes all kinds of recording devices in which data that can be read by a computer system is stored. Examples of the computer readable medium may include a hard disk drive (HDD), a solid state disk (SSD), a silicon disk drive (SDD), a ROM, a RAM, a CD-ROM, a magnetic tape, a floppy disk, an optical data storage device, and the like, or be implemented in the form of a carrier wave (e.g., transmission over the internet). Accordingly, the above detailed description should not be construed in all aspects as limiting, and be considered illustrative. The scope of the present disclosure should be determined by rational interpretation of the appended claims, and all changes within the equivalent range of the present disclosure are included in the scope of the present disclosure.

What is claimed is:

1. A method of inspecting a sound input/output device, comprising:

outputting a sound signal through a speaker, and receiving a feedback signal of the sound signal through a microphone;

acquiring a first spectrum for the sound signal and a second spectrum for the feedback signal when at least one specific signal for inspecting performance of the speaker or the microphone is detected from the sound signal;

detecting an error state of either the speaker or the microphone by using a correlation between the first and second spectrums, wherein the error state is detected by determining a cross-correlation coefficient between the first and second spectrums and detecting an error state of either the speaker or the microphone by comparing the cross-correlation coefficient with a predetermined threshold; and extracting a plurality of reference points having the cross-correlation coefficient equal to or greater than a predetermined reference value and determining a section between the extracted plurality of reference points as an error analysis section.

2. The method of claim 1, wherein the sound signal and the feedback signal are multitone sound waves composed of a linear sum of sinusoidal waves having a plurality of frequency components.

3. The method of claim 1, further comprising:

determining a cross-correlation coefficient of each of a plurality of frequency bands for the sound signal and the feedback signal; and determining as the error state when an average value of the cross-correlation coefficient of each of the plurality of frequency bands is less than the predetermined threshold.

4. The method of claim 1, further comprising:

determining a cross-correlation coefficient of each of a plurality of frequency bands for the sound signal and the feedback signal;

determining a noise level by receiving ambient noise through the microphone, and determining a reverberation level of the feedback signal;

generating an output by applying an average value of the cross-correlation coefficient of each of the plurality of frequency bands, the noise level, and the reverberation level to a pre-learned error detection model; and determining the error state based on the output.

5. The method of claim 1, wherein the at least one specific signal is a voice signal for a predetermined wake-up word.

6. The method of claim 1, wherein when the at least one specific signal is not detected for a predetermined time, the first and second spectrums are acquired in response to a general sound signal, and the error state is detected.

7. The method of claim 1, further comprising:

when the at least one specific signal is not detected for a predetermined time, adding a signal having a highest output frequency for the predetermined time to the at least one specific signal.

8. The method of claim 1, further comprising:

searching a history related to the detection of the error state; and controlling an AI device having the sound input/output device to travel to a designated place if the same detection result is repeated more than a predetermined number.

9. A method of inspecting a sound input/output device, in the method of inspecting the sound input/output device by a communication-connected server, comprising:

receiving sound signal information output from an external device and feedback signal information on an output sound signal from the external device;

acquiring a first spectrum for the sound signal and a second spectrum for the feedback signal when at least one specific signal for inspecting performance of a speaker or a microphone is detected from the sound signal information;

detecting an error state of either the speaker or the microphone by using a correlation between the first and second spectrums, wherein the error state is detected by determining a cross-correlation coefficient between the first and second spectrums and detecting an error state of either the speaker or the microphone by comparing the cross-correlation coefficient with a predetermined threshold; and extracting a plurality of reference points having the cross-correlation coefficient equal to or greater than a predetermined reference value and determining a section between the extracted plurality of reference points as an error analysis section.

10. The method of claim 9, wherein the sound signal and the feedback signal are multitone sound waves composed of a linear sum of sinusoidal waves having a plurality of frequency components.

11. The method of claim 9, further comprising:

determining a cross-correlation coefficient of each of a plurality of frequency bands for the sound signal and the feedback signal; and determining as the error state when an average value of the cross-correlation coefficient of each of the plurality of frequency bands is less than the predetermined threshold.

12. The method of claim 9, further comprising:

determining a cross-correlation coefficient of each of a plurality of frequency bands for the sound signal and the feedback signal;

determining a noise level by receiving ambient noise through the microphone, and determining a reverberation level of the feedback signal;

generating an output by applying an average value of the cross-correlation coefficient of each of the plurality of frequency bands, the noise level, and the reverberation level to a pre-learned error detection model; and determining the error state based on the output.

13. The method of claim 9, wherein the at least one specific signal is a voice signal for a predetermined wake-up word.

14. The method of claim 9, wherein when the at least one specific signal is not detected for a predetermined time, the first and second spectrums are acquired in response to a general sound signal, and the error state is detected.

15. The method of claim 9, further comprising:

when the at least one specific signal is not detected for a predetermined time, adding a signal having a highest output frequency for the predetermined time to the at least one specific signal.

16. A non-transitory computer-readable recording medium on which a program for implementing a method of inspecting a sound input/output device, the method comprising:

outputting a sound signal through a speaker, and receiving a feedback signal of the outputted sound signal through a microphone;

acquiring a first spectrum for the sound signal and a second spectrum for the feedback signal when at least one specific signal for inspecting performance of the speaker or the microphone is detected from the sound signal;

detecting an error state of either the speaker or the microphone by using a correlation between the first and second spectrums, wherein the error state is detected by determining a cross-correlation coefficient between the first and second spectrums and detecting an error state of either the speaker or the microphone by comparing the cross-correlation coefficient with a predetermined threshold; and extracting a plurality of reference points having the cross-correlation coefficient equal to or greater than a predetermined reference value and determining a section between the extracted plurality of reference points as an error analysis section.

* * * * *